US007157848B2

(12) United States Patent
Tang et al.

(10) Patent No.: US 7,157,848 B2
(45) Date of Patent: Jan. 2, 2007

(54) FIELD EMISSION BACKLIGHT FOR LIQUID CRYSTAL TELEVISION

(75) Inventors: Xinhe Tang, Vienna (AT); Ernst Hammel, Vienna (AT); Daniel Den Engelsen, Eindhoven (NL); Edward Cosman, Eindhoven (NL); Cornelis Kortekaas, Eindhoven (NL)

(73) Assignee: Electrovac Fabrikation Elektrotechnischer Spezialartikel GmbH, Klosterneuburg (AT)

( * ) Notice: Subject to any disclaimer, the term of this patent is extended or adjusted under 35 U.S.C. 154(b) by 245 days.

(21) Appl. No.: 10/754,176

(22) Filed: Jan. 9, 2004

(65) Prior Publication Data

US 2004/0245910 A1 Dec. 9, 2004

Related U.S. Application Data

(60) Provisional application No. 60/476,431, filed on Jun. 6, 2003.

(51) Int. Cl.
*H01J 1/62* (2006.01)
*H01J 63/04* (2006.01)

(52) U.S. Cl. ..... 313/495; 313/496; 313/336; 313/351; 313/309; 313/310

(58) Field of Classification Search ..... 313/495–497, 313/336, 351, 309–311; 315/169.3
See application file for complete search history.

(56) References Cited

U.S. PATENT DOCUMENTS

| | | | | |
|---|---|---|---|---|
| 5,347,201 | A | 9/1994 | Liang et al. | |
| 5,773,921 | A | 6/1998 | Keesmann et al. | 313/309 |
| 5,973,444 | A | 10/1999 | Xu et al. | 313/309 |
| 6,031,328 | A | 2/2000 | Nakamoto | |
| 6,087,765 | A | 7/2000 | Coll et al. | 313/309 |
| 6,100,628 | A | 8/2000 | Coll et al. | 313/310 |
| 6,232,706 | B1 | 5/2001 | Dai et al. | 313/309 |
| 6,239,547 | B1 * | 5/2001 | Uemura et al. | 313/495 |
| 6,277,318 | B1 | 8/2001 | Bower et al. | 264/346 |
| 6,312,303 | B1 | 11/2001 | Yaniv et al. | 445/24 |
| 6,350,388 | B1 | 2/2002 | Knappenberger et al. | 216/42 |
| 6,380,671 | B1 | 4/2002 | Lee | |
| 6,417,606 | B1 | 7/2002 | Nakamoto et al. | 313/336 |
| 6,426,590 | B1 | 7/2002 | Chung et al. | |
| 6,440,761 | B1 | 8/2002 | Choi | 438/20 |
| 6,445,125 | B1 | 9/2002 | Na et al. | 313/497 |
| 6,464,890 | B1 | 10/2002 | Knappenberger et al. | 216/42 |
| 6,504,292 | B1 * | 1/2003 | Choi et al. | 313/310 |

(Continued)

FOREIGN PATENT DOCUMENTS

EP 1 176 234 A2 2/2002

(Continued)

OTHER PUBLICATIONS

ASTM Standard Designation: D 3359-02, pp. 1-7 (2002).

(Continued)

*Primary Examiner*—Nimeshkumar D. Patel
*Assistant Examiner*—Kevin Quarterman
(74) *Attorney, Agent, or Firm*—Christopher Paradies; Fowler White Boggs Banker P.A.

(57) ABSTRACT

A field emission device for use as a backlight of a liquid crystal display comprises a conductive anode having a light-emitting layer and a cathode separated from the anode by a spacer. The cathode comprises nanofiber electron emitters. For example, the nanofiber electron emitters comprise a substrate, a conductive film adhered to the substrate and a plurality of isolated, hemispheroidal nanofiber clusters that are capable of emitting electrons at high current density and low field strength.

41 Claims, 21 Drawing Sheets

U.S. PATENT DOCUMENTS

| | | | | |
|---|---|---|---|---|
| 6,741,019 | B1 * | 5/2004 | Filas et al. | 313/355 |
| 6,914,372 | B1 * | 7/2005 | Akiyama et al. | 313/309 |
| 2001/0024633 | A1 | 9/2001 | Lee et al. | |
| 2001/0050537 | A1 | 12/2001 | Itoh et al. | |
| 2002/0076846 | A1 | 6/2002 | Ihm | 438/34 |
| 2002/0084502 | A1 | 7/2002 | Jang et al. | 257/432 |
| 2002/0160111 | A1 | 10/2002 | Sun et al. | 427/248.1 |
| 2002/0182970 | A1 | 12/2002 | Liu et al. | 445/51 |
| 2002/0197928 | A1 | 12/2002 | Ahn et al. | 445/59 |
| 2003/0025851 | A1 | 2/2003 | Cheng et al. | |
| 2003/0090190 | A1 | 5/2003 | Takai | 313/311 |
| 2003/0122771 | A1 | 7/2003 | Sumiyoshi et al. | |
| 2004/0104668 | A1 * | 6/2004 | Lee et al. | 313/496 |

FOREIGN PATENT DOCUMENTS

| | | | |
|---|---|---|---|
| WO | WO-00/30141 | A1 | 5/2000 |
| WO | WO-03/081366 | A | 10/2002 |
| WO | 03/025966 | A | 3/2003 |
| WO | WO-03/026796 | A2 | 4/2003 |

OTHER PUBLICATIONS

Definition of "feedstock", U.S. Environmental Protection Agency, Terminology Reference System, http://www.epa.gov/trs, 1 page, downloaded Aug. 18, 2003.

Definition of"oblate spheroid," http://mathworld.wolfram.com, 9 pages, downloaded Mar. 12, 2003.

Definition of"prolate spheroid," http://mathworld.wolfram.com, 3 pages, downloaded Mar. 12, 2003.

Starch Soluble, MSDS No. S6505, 6 pages, downloaded from http://www.jtbaker.com on Jul. 3, 2003.

X.D. Bai et al., "Synthesis and field-emission behavior of highly oriented boron carbonitride nanofibers," Applied Physics Letters 76(18):2624-2626 (2000), abstract downloaded from http://content.aip.org on Aug. 12, 2003.

J. Chen et al., "Field emission from crystalline copper sulphide nanowire arrays," Applied Physics Letters 80(19):3620-3622, 2002, abstract downloaded from http://content.aip.org on Aug. 12, 2003.

Y. Chen et al., "Field emission of different oriented carbon nanotubes," Applied Physics Letters 76(17):2469-2471 (2000), abstract downloaded from http://content.aip.org on Aug. 12, 2003.

K.A. Dean, "The environmental stability of field emission from single-walled carbon nanotubes," Applied Physics Letters 75(19):3017-3019 (1999), abstract downloaded from http://content.aip.org. on Aug. 12, 2003.

K.A. Dean et al., "Current saturation mechanisms in carbon nanotube field emitters," Applied Physics Letters, 76(3):375-377 (2000), abstract downloaded from http://content.aip.org on Aug. 12, 2003.

L. Dong et al., "ZnO nanowires formed on tungsten substrates and their electron field emission properties," Applied Physics Letters 82(7):1096-1098 (2003), abstract downloaded from http://content.aip.org on Aug. 12, 2003.

Y-H. Lee et al., "Tungsten nonowires and their field electron emission properties," Applied Physics Letters 81(4):745-747, abstract downloaded from http://content.aip.org on Aug. 12, 2003.

S.C. Lim et al., "Saturation of emission current from carbon nanotube field emission array," AIP Conference Proceedings 590(1):221-224 (2001), abstract downloaded from http://content.aip.org on Aug. 12, 2003.

Z. Pan et al., "Oriented Silicon Carbide Nanowires: Synthesis and Field Emission Properties," Adv. Materl. 12(16):1186-1190 (2000).

W. Shi et al., "Laser Ablation Synthesis and Optical Characterization of Silicon Carbide Nanowires," J. Am. Ceram. Soc. 83(12):3228-3330 (2000).

M. Sveningsson et al., "Field Emission from Multiwalled Carbon Nanotubes," AIP Conference Proceedings 633(1):548-551 (2002), abstract downloaded from http://content.aip.org on Aug. 12, 2003.

K.W. Wong et al., Field-emission characteristics of SiC nanowires prepared by chemical-vapor deposition, Applied Physics Letters 75(19):2918-2920, abstract downloaded from http://content.aip.org on Aug. 12, 2003.

C.Y. Zhi et al., "Enhanced field emission from carbon nanotubes by hydrogen plasma treatment," Applied Physics Letter 81(9):1690-1692, abstract downloaded from http://content.aip.org on Aug. 12, 2003.

Y.W. Zhu, "Efficient field emission from ZnO nanoneedle arrays," Applied Physics Letters 83(1):144-146 (2003), abstract downloaded from http://content.aip.org on Aug. 12, 2003.

Gröning, O. et al: "Field emission properties of carbon nanotubes" Journal of Vacuum Science & Technology B: Microelectronics Processing and Phenomena, American Vacuum Society, New York, NY, US, vol. 18, No. 2, Mar. 2000, pp. 665-678.

Patent Abstracts of Japan, vol. 2003, No. 09, Sep. 3, 2003 & JP 2003 131-224 A, May 8, 2003 (Abstract Only); (US Equivalent is submitted herewith as US 2003/122771 A1 to Sumiyoshi Ken et al.).

"Cathodoluminescent Backlight for Liquid Crystal Displays", Research Disclosure, Mason Publications, Hampshire, GB, No. 321, Jan. 1991, p. 74.

* cited by examiner

FIELD EMISSION BACKLIGHT FOR LIQUID CRYSTAL TELEVISION

RELATED APPLICATION

This application claims the benefit of U.S. Provisional Application No. 60/476,431, filed Jun. 6, 2003, which is incorporated in its entirety by reference herein.

FIELD OF THE INVENTION

The field of the invention is backlights for liquid crystal televisions.

BACKGROUND OF THE INVENTION

Backlights for liquid crystal displays (LCDs) based on Cold Cathode Fluorescent Lamps (CCFL) are known that have a high lumen efficacy of 50–60 lm/W. This high lumen efficacy is due to the unique properties of mercury vapor. However, due to environmental constraints the display industry is forced to develop alternative backlights without using mercury.

CCFL backlights which are used in large area TVs have an unacceptably thick direct illumination package, which increases the thickness of flat panel televisions. A CCFL backlight for scanning or scrolling with an adequate duty cycle that effectively suppresses motion blur is very difficult to achieve for commercially acceptable televisions.

An alternative backlight uses a flat xenon discharge lamp, having a lumen efficacy of ~18 lm/W. Thus, efficiency is sacrificed for the elimination of the hazards of mercury.

Field Emission Displays (FED) are expensive, and commercial production of FEDs based on Spindt type field emitters is very limited. Televisions differ from computer displays, because televisions primarily display moving images and not merely text, still pictures and graphic images. LCDs suffer from motion blurring due to the sample-hold effect. Field emission backlight devices are well suited for scrolling or scanning of pixels, which reduces the motion blurring caused by the sample-hold effect.

The parameters presented in Table 1 are goals based on the performance of conventional cathode ray tubes (CRTs), which support high average luminance and high dynamic range. For example, the factor between peak luminance of CRTs may be as great as factor of six. In conventional liquid crystal televisions the average luminance is lower, because LCDs usually have better contrast than CRTs. Also, the dynamic range is usually lower. So, a peak luminance of 8,000–10,000 cd/m$^2$ is a desirable objective for a liquid crystal television backlight. In this case 16 lamps of 375 lumens each are required for a 32" wide-screen, liquid crystal television.

Furthermore, scanning or blinking backlights are used to reduce motion blur in LCD's, the lumen requirement is much larger. In Table 1 it is indicated that that for a 10% duty cycle 400 lamps would be required, which is commercially impractical.

SUMMARY OF THE INVENTION

A field emission backlight for liquid crystal display comprises a nanofiber electrode integrated in a flat, thin backlight. In alternative embodiments, a non-scanning diode structure and a scanning triode structure are used. The liquid crystal display has high contrast, good brightness and good resolution with low power requirements and a thin screen.

DETAILED DESCRIPTION OF THE INVENTION

Figure 1:
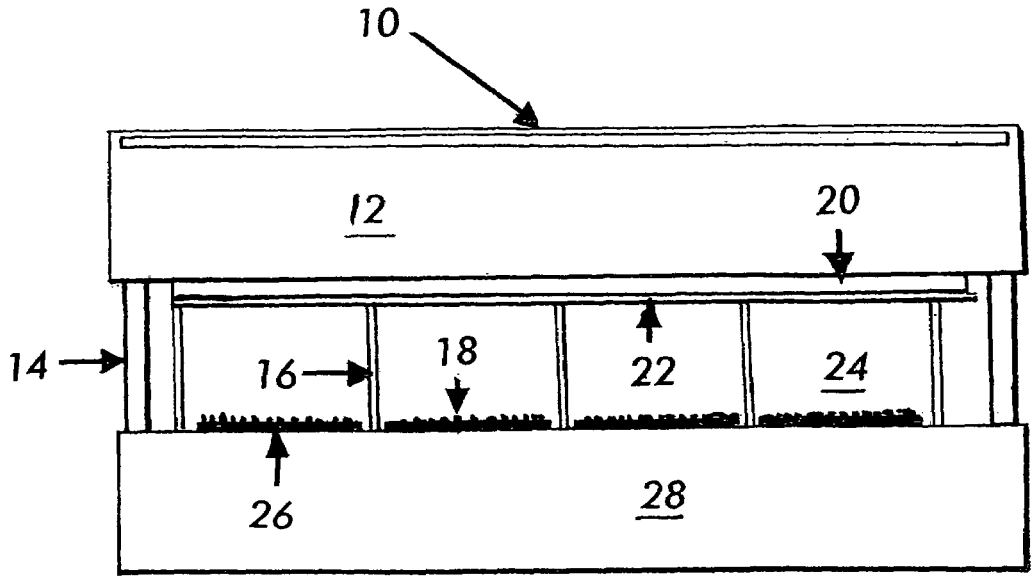
FIG. 1 illustrates one embodiment of the present invention.

In FIG. 1 an example is given of a non-scanning field emission backlight. This field emission backlight comprises a nanofiber emitter plate 18 and an anode plate 20. The spacing 24 between these plates is in a range from 0.5 mm to 3 mm, preferably about 1.5 mm. A spacer frame 16 is positioned between the anode and emitter plate to prevent deflection of either the anode or emitter plate under the vacuum pressure used for efficient operation of the backlight. The backlight further comprises vacuum seals 14 around the edges of the backlight and a getter (not shown in FIG. 1) which maintains the vacuum in the field emission backlight. The getter can be any material that reacts with vapors that would unacceptably increase the pressure in the gap and damage the emitters during operation.

The emitters 18 comprise conductive electrodes 26 on which the nanofibers are attached. "Nanofibers" is used herein to mean any of a family of filamentous nanostructures, including single-walled nanotubes, multi-walled nanotubes, nanowires and other "one-dimensional" nanostructures having an outer diameter in the nanoscale. For example, carbon nanofibers having a graphitic crystal structure may be grown in situ or printed on the surface of the conductive electrodes. For example, the conductive electrodes are inorganic or organic conductors, preferably metal, more preferably aluminum or aluminum alloy. Printed carbon nanotubes may be adhered to the conductive electrodes 26 using any conventional process.

For example, the anode 20 includes a light-emitting layer, such as a non-structured phosphorescent or fluorescent layer. In one embodiment, the light-emitting layer is a mixture of phosphors, such as red, green and blue. Alternatively, phosphors emitting different colors of light may be separated into individual pixels or portions of a single pixel. In another alternative, the phosphors may be separated into separate, discrete layers that emit different light of different colors. The color point can be tuned to any desired color by adjusting the mix of light-emitting molecules. In one preferred embodiment, the color of a mixture of phosphors produces a white light at operating conditions. In one embodiment, a reflective film 22, such as an aluminum film, is applied between the phosphor layer and the gap to increase the luminance observed from the display by reflecting light emitted in the direction of the reflective film 22. The anode 20 may further comprise a transparent plate 12 and a light scattering layer (diffuser) 10 that helps to make the luminance uniform over the surface of the active display. The base 28 supports the emitters 18 and the conductive electrodes 26.

Figure 2:
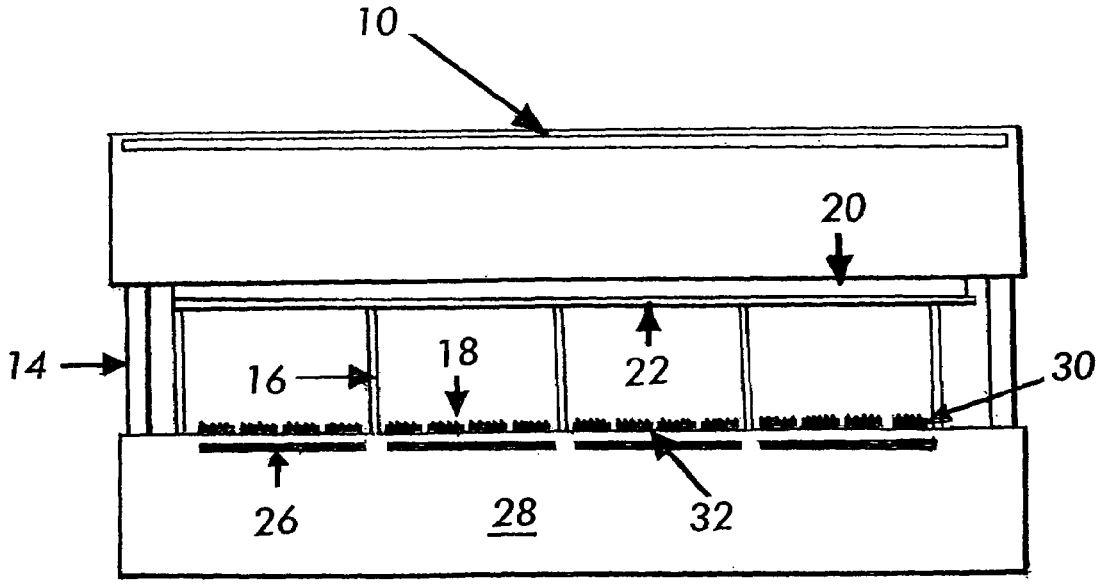
FIG. 2 illustrates another embodiment of the present invention.
Figure 3:
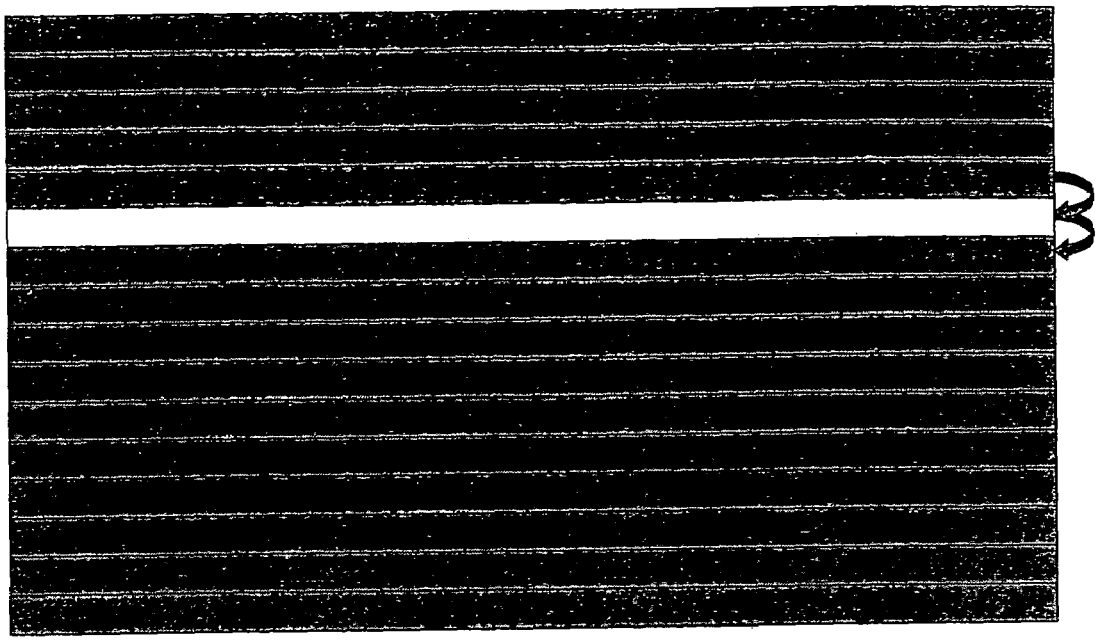
FIG. 3 illustrates scrolling, as one example of a method to suppress motion blur of a liquid crystal television.

FIG. 2 shows one embodiment of a scanning field emission backlight. In this embodiment, the emitter 18 comprises a triode structure 32. The voltage between the cathode electrode 26 and the gate of the triode controls the intensity of the emission from emitters 18. In one embodiment, scrolling is achieved by activating successive emitter rows, as illustrated in FIG. 3. For example, a duty cycle of 6.3% is achieved by scrolling single rows one at a time. In this way the motion blur in liquid crystal televisions is suppressed. By scrolling rows simultaneously, the duty cycle can be increased with a trade off in increasing motion blur.

Table 1 shows backlight parameters for a 32" wide-screen television display, for example. From Table 1 it can be deduced that the instantaneous luminance of a single scanned line of cathode must be very high to obtain the desired peak luminance. For example, a duty cycle of 10%, an instantaneous luminance of 200,000 cd/m$^2$ would be necessary. Such luminance may be impracticable. However, then the backlight is equipped with both column drivers and row drivers, then the luminance can be varied along the line according to the needs of the video content, e.g. from peak luminance to black. Thus, using both column and row drivers saves power and extends the useful lifetime of the phosphor.

Figure 4:
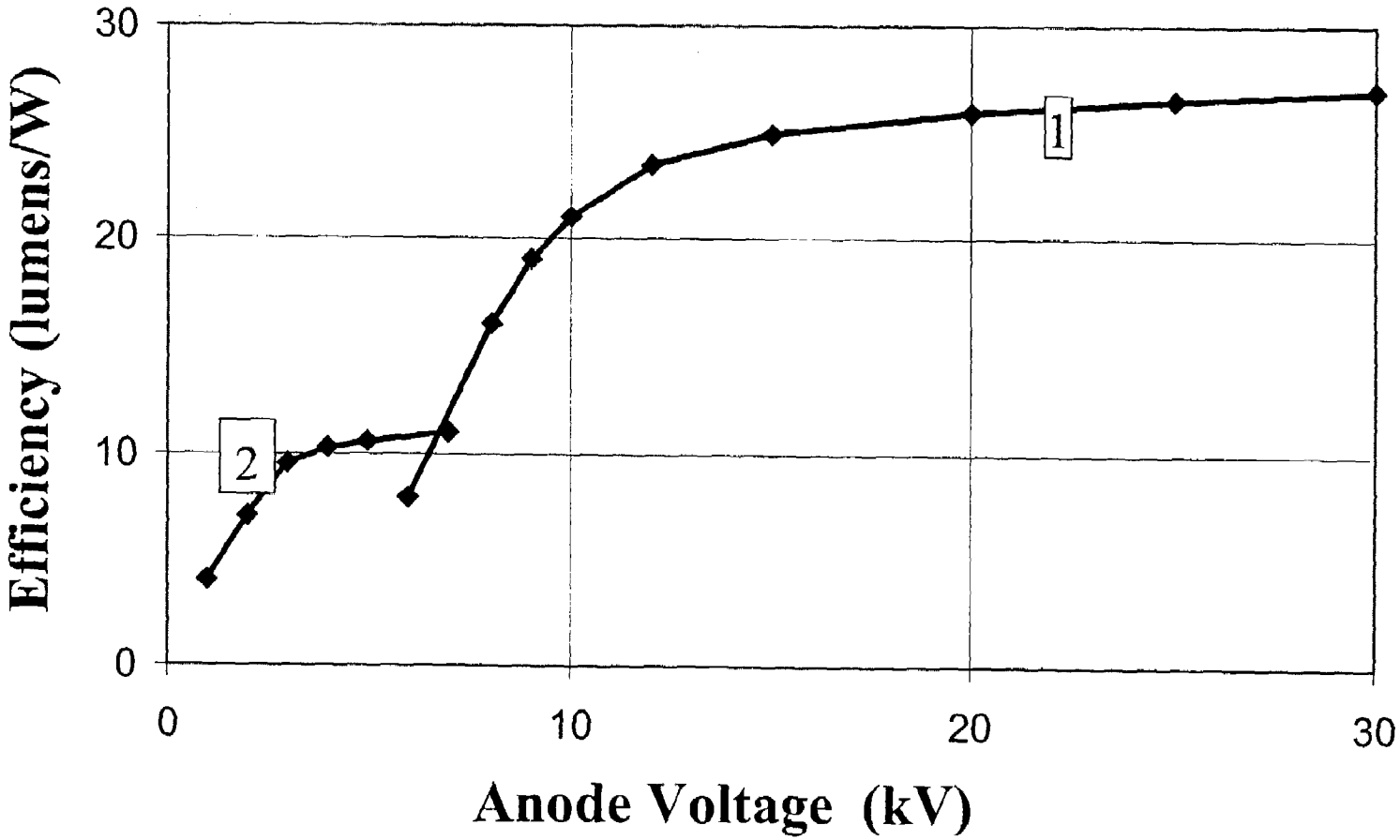
FIG. 4 shows the efficiency versus voltage for (1) conventional cathode ray tube phosphors having a thin aluminum layer on the surface and (2) low voltage phosphors without an aluminum layer.

In one embodiment, the voltage between the anode 20 and the emitter 18 is greater than 2 kV. FIG. 4 shows efficiency of a white-light field emitter backlight as a function of voltage. By this example, a voltage greater than 10 kV achieves an efficiency using conventional CRT phosphor as shown by curve 1. Curve 2 shows that an efficiency of 10 lm/W is achieved at a voltage of less than 8 kV using low voltage phosphors and an aluminum blocking layer. In one embodiment, a backlight has a peak luminance of at least 1,000 cd/m$^2$ using low voltage phosphors and an aluminum blocking layer. In an alternative embodiment using CRT phosphors, the backlight has a peak luminance of at least 3,000 cd/m$^2$.

A voltage greater than 12 kV is associated with a generation of X-rays; therefore a range of voltage from 10 kV to no greater than 12 kV is preferred in the example shown in FIG. 4, if a high screen efficiency is desired. If a lower screen efficiency is acceptable, then the voltage may be less than 8 kV, for example, by using low voltage phosphors.

In one embodiment, the electron emitter 18 comprises a conductive electrode 26 and isolated clusters 30 of carbon nanofibers grown in situ by chemical vapor deposition on the electrode as illustrated in FIG. 2. The in situ growth process produces fiber clusters 30, preferably isolated hemispheroidal clusters, having advantageous morphology and bond strength that is not produced by other methods of fabricating carbon nanofiber based emissive films.

Other materials are known that can be synthesized via chemical vapor deposition as nanofibers, which may be suitable for use as nanofiber electron emitters for use in field emissive displays. For example, these materials include metal nanowires, such as bismuth, tungsten and silver, metal oxide nanofibers, such as ZnO, metal sulfide nanofibers, such as $Cu_2S$ and $MoS_2$ and other compounds that form nanofiber morphologies, such as gallium nitride, boron nitride, boron carbide nitride, silicon and silicon carbide. In one example, SiC nanofibers may be synthesized by a reaction between carbon nanofibers and silica, and the SiC nanofibers adopt the same morphology as the carbon nanofiber clusters. For example, SiC synthesis is described in "Oriented Silicon Carbide Nanowires: Synthesis and Field Emission Properties," by Zhengwei Pan et al., Adv. Mater. 2000, 12, No. 16, Aug. 16, 2000, which is incorporated herein by reference in its entirety. Various methods are used to grow nanofibers. Each of these methods results in characteristically different nanofiber morphologies and nanofiber chemistry which greatly affects the emission characteristics of the nanofibers.

An electron emitter 18 comprises a conductive electrode 26 and isolated clusters of carbon nanofibers 30 grown in situ by chemical vapor deposition on an electrode. The nanofiber clusters emit electrons at low voltages and at high current densities, and adhere to the electrode. The electron emitter is supported by a substrate and is operably connected by a wiring pattern to a voltage source. Preferably, the nanofibers within a nanofiber cluster 30 are grown such that they are entangled, preventing individual nanofibers from moving across the gap between the cathode and anode of a field emission device.

Figure 20:
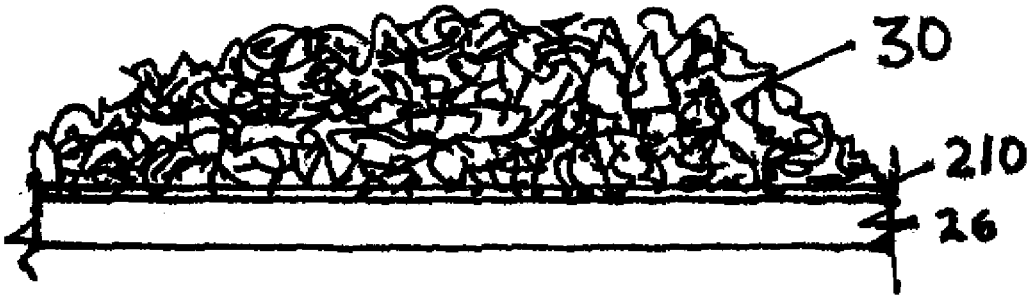
FIG. 20 is a diagrammatic detail view of a portion of an emitter 18 illustrated in FIG. 2.

The conductive electrode is joined to the substrate in a conventional manner, such as bonding or adhering a layer of metal to an insulating substrate, using sputtering, for example. The layer of metal may be conventionally patterned and etched to form a pattern of pixels and a wiring pattern, for example. Then, a catalytic precursor is deposited on the conductive electrode. The precursor comprises a catalyst for growing carbon nanofibers by chemical vapor deposition, a solvent and aggregated non-catalytic particles. For example, as illustrated schematically in FIG. 20, an emitter 18 may be formed when the catalytic precursor is applied to the pixels as a paste or slurry. The composition of the catalytic precursor is selected such that isolated carbon nanofiber clusters 30 are formed during nanofiber growth, and an adhesion layer 210 is capable of being formed between the electrode 26 and the nanofiber clusters 30 during preparation of the nanofibers, such as during a step of drying, heating and/or reducing the catalyst precursor and/or during growth of the nanofibers. For example, the adhesion layer 210 forms by a chemical reaction between the electrode and the compounds formed from the precursors during processing of the cathode 26.

An electron emitter comprises a conductive electrode and fibrous clusters 30 formed by in situ catalytic growth of nanofibers from a catalyst precursor. The precursor comprises, in one embodiment, a mixture of catalyst, non-catalytic particulates, a binder and a solvent. Preferably, the catalyst is selected to grow graphitic carbon nanofibers. Alternatively, nanofibers may be made of other emissive materials by conventional chemical vapor deposition processes using the process for preparing and activating clustered catalyst particulates as disclosed herein. The precursor is deposited on the conductive electrode, for example, by spraying, printing and other physical or chemical deposition procedures. The precursor may be deposited in a pattern and/or patterned after deposition using conventional processes such as masking or photolithography.

For example, nanofibers may be single-walled nanotubes or multi-walled nanotubes or non-tubular nanowires or a mixture of these and other fibrous morphologies. Preferably, at least a portion of fibrous graphitic carbon is in the form of multi-walled carbon nanotubes. More preferably, at least half of the nanofibers are multi-walled nanotubes. Multi-walled carbon nanotubes have excellent emissive properties and inherently long service stability. Single-walled carbon nanotubes also have good emissive properties, such as a low threshold field strength for electron emission (e.g. less than 0.2 volts per micrometer), but the growth conditions for single-walled nanotubes are more difficult to achieve for large area displays. Also, single-walled carbon nanotubes typically have shorter useful lifetimes than multi-walled carbon nanotubes.

Figure 11:
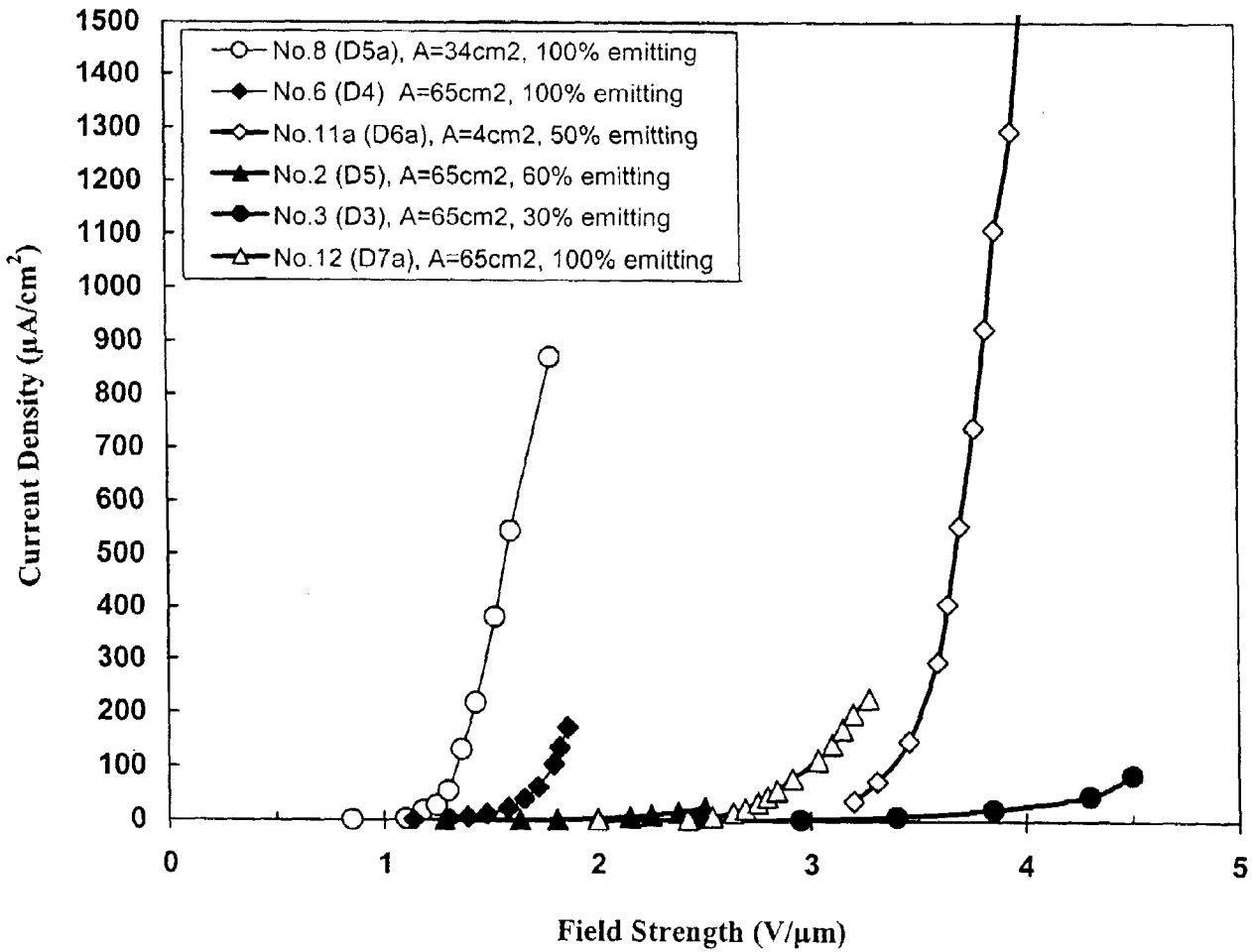
FIG. 11 shows a graph showing the current density versus gap voltage for several embodiments.

A diode comprising an anode having a luminescent material, a conductive cathode and an electron emissive film having a plurality of isolated clusters of carbon nanofibers was tested and had a pixel current density versus field strength as shown in FIG. 11. The field strength threshold is less than two (2) volts per micrometer (V/μm), as depicted in example 8, for example. The field strength threshold is preferably from 1 V/μm to 3.5 V/μm. Preferably, the maximum current density of the as-grown nanofibers, after assembly in a field emission diode exceeds 900 $\mu A/cm^2$. More preferably, the maximum current density exceeds 2.7 $mA/cm^2$. It is known that posttreatment of the nanofibers by processes such as ultraviolet exposure, plasma, laser ablation and/or ion bombardment improves emission characteristics compared to as-grown nanotubes.

In one embodiment, the conductive electrode and wiring pattern is a metal, such as aluminum, chromium, gold, platinum and other metals and alloys thereof. Nickel, iron and cobalt are not included in the conductive electrode and wiring pattern at levels sufficient to act as a catalyst for carbon nanofiber growth. Preferably, the electrode is aluminum, and the aluminum which forms an adhesion layer with the catalyst clusters.

Adhesion between the substrate and the conductive wiring pattern is achieved by any conventional means. For example, a thin layer of aluminum, e.g. 0.1 μm, is formed by sputtering an aluminum on a substrate, such as an insulating substrate or a semiconductor substrate. In one specific embodiment, the substrate is a glass. Then, a wiring pattern and pixels are formed using photolithography and/or a wet chemical etch of the aluminum layer. For example, the wiring pattern may include electrodes in the shape of single pixels connected by wired traces capable of being connected to electronic logic circuitry.

Then, a catalyst precursor is deposited on the surface of the electrodes. For example, catalyst clusters are deposited by spraying, printing, stamping or any other feasible physical or chemical deposition method. Patterning may be achieved by lithography. More preferably, the pattern is complete as deposited, reducing the number of processing steps.

In one embodiment, printing of the catalyst clusters is achieved by one of screen printing, soft printing and micro-contact printing. For example, the process of precursor deposition leaves isolated catalyst clusters dispersed across the surface of each of the electrodes. This process may be used for both large surface areas and fine pixel dimensions. The cathode may cover a large area, providing a uniform light emitting surface. The ease of deposition of the catalyst precursor on the conductive substrate allows large electron emitting areas to be fabricated inexpensively.

In one embodiment, the precursor clusters are physically moved or removed during an inspection step prior to catalytic growth of nanofiber clusters. By physically moving or removing certain non-uniform clusters, a uniformly sized and evenly distributed arrangement of clusters is achieved. Preferably, a deposition process is used that disperses uniformly sized and evenly distributed precursor clusters over a large surface without the need for subsequent movement or removal of precursor clusters before catalytic growth of nanofiber clusters. By evenly dispersing and uniformly sizing the fibrous clusters, the resulting light intensity of a pixel in a field emission device appears even and uniform to the human eye. In one such embodiment, an inspection step after deposition is used to reject substrates not having both the uniform size and even distribution of precursor clusters prior to further processing. Then, the rejected substrates are easily cleaned and reused in a subsequent deposition process after process parameters are modified, for example, by servicing the equipment used for the deposition process. Thus, an inexpensive automated process is capable of producing electron emitters for use in comparatively inexpensive and large-scale displays. Herein, the term "large-scale displays" refers to displays of about a 30-inch diagonal or larger.

The cylindrical diameter of carbon nanofibers relates directly to the size of the active catalyst particulates used in catalytic growth of the carbon nanofibers, e.g. iron/nickel particulates in clusters on the surfaces of non-catalytic particles. Therefore, decreasing the size of the catalyst particulates results in a finer cylindrical diameter of the carbon nanofibers grown from the catalyst particulates. It is believed, without being limiting in any way, that reducing the cylindrical diameter of the carbon nanofibers leads to a direct reduction in the threshold field strength at which electrons are emitted from the cathode to the anode. All else being equal, it is preferable to have a low field strength threshold; therefore, smaller catalyst particulates are more desirable than larger catalyst particulates, if the rate of catalytic growth, useful lifetime of the screen and adherence to the conductive electrode during operation otherwise remain within acceptable limits.

In one embodiment, the average size of a catalyst particulate is at least 30 nm. Preferably, the average size is limited to a range no greater than 150 nm. Such particulates have been shown to grow carbon nanofibers in one embodiment of the invention that have a mean outer diameter of at least about 50 nm. "About" is used here to indicate that the measurement of nanofiber diameters include both systematic and random errors. Preferably, the mean outer diameter of carbon nanofibers is no greater than about 200 nm, which corresponds to a maximum catalyst particulate size of 150 nm, for example.

The average size and uniformity of the size of catalyst particulates is determined by the processing steps used to precipitate the catalyst particulates from solution, as well as the type of catalyst precursors selected, for example metal nitrates, sulfates and chlorides. One preferred process is co-precipitation of solutions containing soluble metal nitrates, for example an iron nitrate and a nickel nitrate, on non-catalytic particle clusters. Other catalytic metal compounds and non-catalytic particulates and compounds may be added to the solution to control the size and activity of the catalyst precipitates.

Precipitation of metal compounds is initiated, for example, by adding a precipitating agent or by evaporation of the solvent. The resulting catalyst clusters are dried, and the metal precipitates are calcined to convert the precipitates to metal oxides or mixed metal oxides. The calcined metal oxides are then reduced at an effective temperature in a reducing atmosphere, e.g. hydrogen, for an effective time to produce the desired metal particulates.

Preferably, the process selected produces an adhesion layer between the catalyst clusters and the conductive electrode simultaneously with the precipitation and activation of the catalyst particulates. Then, carbon nanofibers are grown by catalytic growth from the catalyst during exposure to a reactive atmosphere at a reaction temperature. In one embodiment, the adhesion layer develops or further develops during the catalytic growth of the carbon nanofiber clusters. The adhesion layer prevents degradation of the field effect device during operation by binding the carbon nanofiber clusters to the conductive electrode. This improves the effective lifetime and reduces the rejection rate of electron emitters for use in field effect devices.

In one embodiment, the catalyst precursor is prepared in the form of a paste before being printed. The paste comprises a catalyst for growth of carbon nanofibers, non-catalyzing particulates, a binder for binding the catalyst and the non-catalyzing particles into catalyst clusters and a solvent. Any catalyst for growing nanofibers in a chemical vapor deposition process may be used, such as particles based on the elements nickel, iron and cobalt in the case of carbon nanofibers. Preferably, the catalyst is based on nickel, iron or mixtures of nickel and iron. More preferably, the catalyst is prepared using a mixture of nickel nitrate and iron nitrate dissolved in a solvent that is subsequently precipitated onto non-catalyzing particle clusters or particles. For example, the catalyst precipitates are supported by starch particles and are pretreated to form catalyst clusters prior to CVD of nanofibers. The size of the catalyst clusters are preferably no greater than 5 μm, although larger agglomerations may be acceptable, or even desired, in some applications.

The binder may be any binder compatible with the catalyst, the non-catalyzing particulates and the solvent. For example, the binder may be of cellulose, polyvinyl alcohol and/or a photoresist, such as PMMA. Preferably, the binder is a cellulose, such as ethyl cellulose. Alternatively, the non-catalyzing particles may agglomerate without using a binder. The solvent may dissolve all of the binder, or at least a portion thereof, and all of the catalytic compounds, or at least a portion thereof. The solvent dilutes the paste. In addition, the amount of solvent may be selected to establish an appropriate density of catalyst clusters and a preferred viscosity for the deposition process, such that the catalyst clusters are dispersed on the surface of the electrodes. Preferably, a uniform size and even distribution of catalyst clusters results. For example, the solvent is terpineol, an alcohol or a combination of terpineol and alcohol. The solvent may include additional modifiers, such as higher alcohols, oils and other additives.

For example, the non-catalyzing particles may be of an organic material, an inorganic material or a combination of organic and inorganic materials, such as a starch, including an unpurified starch, a polymer, a metal, an oxide, such as alumina, titania or silica, combinations of these particles and/or these particles coated by an organic film. For example, the organic film can be selected to interact with the metal precipitates binding the metal precipitates to the non-catalyzing particles. In one embodiment, non-catalyzing particles are swellable by the solvent, aiding the binding of the catalyst precipitates on the non-catalyzing particles. Preferably, the composition of the catalyst paste is selected to create an adhesion layer between the electrode and the catalyst clusters. In one example, starch particles are used having a mean maximum lineal dimension, e.g. the mean of the largest distance between any two points of a statistically significant number of non-catalytic particles, in a range from about 5 μm to about 30 μm. More preferably, the mean maximum lineal dimension is between 5 to 10 μm, having a standard deviation of less than 3 μm, preferably about 2 μm. In another, starch has a chemical formula of $(C_6H_{10}O_5)_n$, and unpurified starch may comprise compounds having other chemical formulas.

In one embodiment, even distribution of uniformly-sized starch particles is achieved in the catalyst precursor. Agglomeration of the non-catalytic particles may be prevented by selection of the material of the particles and the solvent. For example, uniformly-sized mung bean starch shows an even distribution in a mixture of an ethyl cellulose, terpineol, an alcohol and catalyst compounds. Also, agitation, chemical additives and other mechanical, physical and chemical de-agglomeration methods may be used to control agglomeration and de-agglomeration, as is known in the art. Precipitating catalyst particulates adhere to the non-catalytic particles, forming catalyst clusters after appropriate processing, such as drying, annealing in an oxidizing atmosphere and reduction of the residuals. For example, corn starch, potato starch, rice starch, wheat starch and bean starch may be used as non-catalytic particles. In one preferred embodiment, mung bean starch, e.g. unpurified mung bean starch, is used to prepare hemispheroidal carbon nanofiber clusters.

After depositing the catalyst precursor on an electrode, a pretreatment step is included to dry the catalyst paste on the surface of the electrode. Then, in a step of thermal pretreatment volatile compounds and most of the other organic compounds of the paste are driven off at a temperature from 350° C. to 550° C. in an oxidizing atmosphere, such as air, oxygen or $CO_2$. The thermal pretreatment temperature may exceed 550° C., but should not exceed a temperature at which the substrate or the conductive wiring pattern is damaged. Heating the catalyst precursor in an oxidizing atmosphere volatilizes at least a portion of the binder, non-catalyzing particulates and solvent, and forms catalyst oxides. Also, chemical changes, such as diffusion, alloying and chemical reactions, between or among the electrode, the catalyst and/or the non-catalyzing particles and/or binder creates an adhesion layer between the electrode and the catalyst clusters. The non-catalyzing particles, if organic, are pyrolized during this step.

Then, the catalyst oxide is reduced to form catalytic nanoparticles within the catalyst clusters. A chemical vapor deposition (CVD) process forms carbon nanofibers from the catalytic nanoparticles. Any CVD process may be used that produces nanofibers, including solid fibers and tubes that exhibit good electron emission. In a preferred embodiment, the CVD process is carried out at about 550° C. in a gas flow reactor using a stream of gas as a feedstock, the feedstock comprising 10 vol % acetylene, 45 vol % hydrogen and 45 vol % argon. Here, "about" is used to indicate a processing range having a temperature at least 500° C. and no greater than 600° C. Preferably, the temperature range is controlled to within 10° C. of 550° C. The growth of the carbon nanofibers is completed in less than ten minutes. The resulting nanofiber clusters are excellent emitters. Preferably, the carbon nanofiber clusters are isolated, uniformly sized and evenly dispersed across the surface of the electrode or electrodes. It is desirable to have a uniform distribution of cluster size and height and an even distribution of clusters within the electrode area such that the resulting light intensity across the electrode is even and uniform to the human eye. Isolated means that the clusters are physically distinguishable on the surface of the electrode and are not screened by the nanofibers of neighboring clusters.

For example, the fibrous clusters have entangled, hemispheroidal shapes, such as prolate hemispheroids or oblate hemispheroids. The composition of the precursor suspension and method of deposition determines the spacing between the catalyst clusters on an electrode. The suspension may be thinned by adding additional solvent to reduce the density of catalyst clusters, for example. In one embodiment, the catalyst precipitation forms a layer, or partial layer, on the non-catalyzing particulates. By increasing the amount of catalyst compound in solution with the solvent, more catalyzing particulates are created and a greater amount of surface area of the non-catalyzing particles is coated with the catalyst. Thus, the density and size of nanofibers is controlled by the amount and density of non-catalyzing particles and the amount of catalyst in solution.

In one embodiment, catalyst clusters comprise non-catalytic organic particles and a cellulose binder, such as ethylcellulose, with a catalyst precipitated on the surface of the organic particles. For example, the particles are suspended in a solvent of terpineol, or terpineol and ethanol, forming a catalyst paste. The catalyst paste is printed onto the surface of a conductive electrode and dried, forming a dispersion of catalyst clusters, as shown in FIG. 1A. A pretreatment causes the catalyst clusters to adhere to the surface of the electrode by an adhesion layer. It is believed that the adhesion layer is formed by intermetallic bonds between the electrodes and catalysts or non-catalytic metals and/or by carbides such as metal carbides formed from the pyrolized non-catalytic organic particulates and or binder. For example, a starch may be used as organic, non-catalyzing particulates, which leads to a tenacious adhesion layer between the catalyst clusters and the conductive electrode after pretreatment.

Intermetallics and metal carbides are observed in electrode grain boundaries that have strong adhesion layers. It is believed that diffusion and alloying phenomena occurring between the catalyst clusters at the grain boundaries on the face of the electrode surface establish good adhesion of the nanofiber emitters to the cathode. FIG. 2A shows that poor adhesion of nanofibers to an aluminum film occurs, when the nanofibers are grown by a method that does not produce an adhesion layer. In one example, the carbon was totally removed during the step of oxidation, reducing or eliminating carbides from the adhesion layer. For example, starch and ethyl cellulose can decompose in an oxidizing atmosphere forming carbon dioxide and water, if oxidation is complete. Otherwise, carbon residue remains after pretreatment, which is available to form carbides, such as metal carbides. Specifically, compressed air from a laboratory compressed air line removes many of the carbon nanofiber clusters from the cathode without an adhesion layer, as shown in FIG. 2A. In contrast, compressed air had no effect on the embodiment of the invention shown in FIG. 2B, which used starch particles and an ethyl cellulose binder to form catalyst clusters having an adhesion layer joining the catalyst clusters to the aluminum film. The difference between adhesion of FIGS. 2A and 2B is primarily attributed to the formation of carbides from residue of the starch particles at the grain boundaries in the metal film of the electrode. The carbon nanofiber clusters of FIG. 2B show excellent adhesion with none of the pixels being removed when subjected to the same use of forced air as the anode shown in FIG. 2A.

For example, a conductive substrate may be a metal film on a non-conductive or semiconductive base. Preferably, the metal film is selected to form an adhesion layer with the catalyst and/or non-catalytic particles. Thus, after growth of the carbon nanofiber clusters, for example by catalytic chemical vapor deposition (CVD), the nanofiber clusters are then adhered to the metal film by the adhesion layer. The adhesion layer formed during the pretreatment tenaciously holds the pixels made of carbon nanofiber clusters to an electrically conductive film after CVD of the nanofibers.

Figure 5:
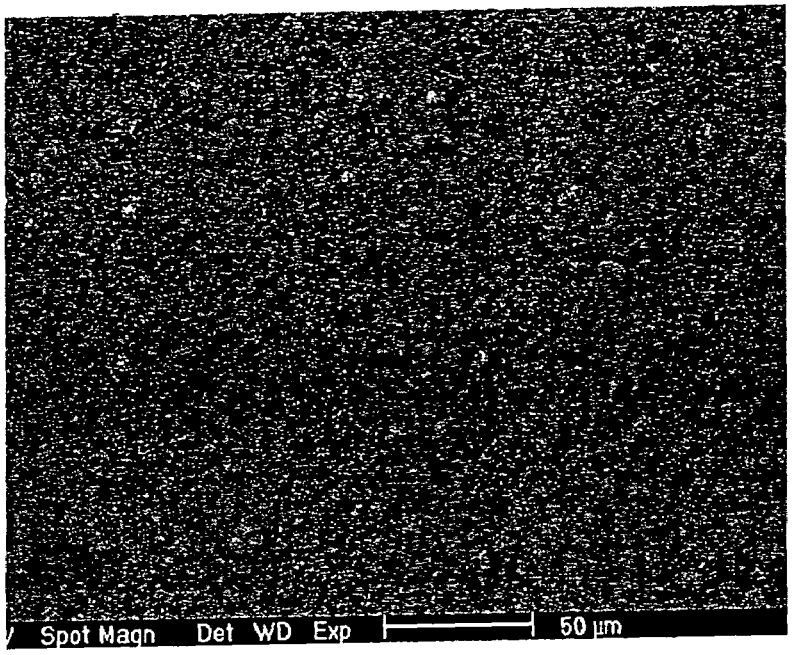
FIG. 5 shows one embodiment of the invention having regular, homogeneous carbon nanofiber clusters.
Figure 6:
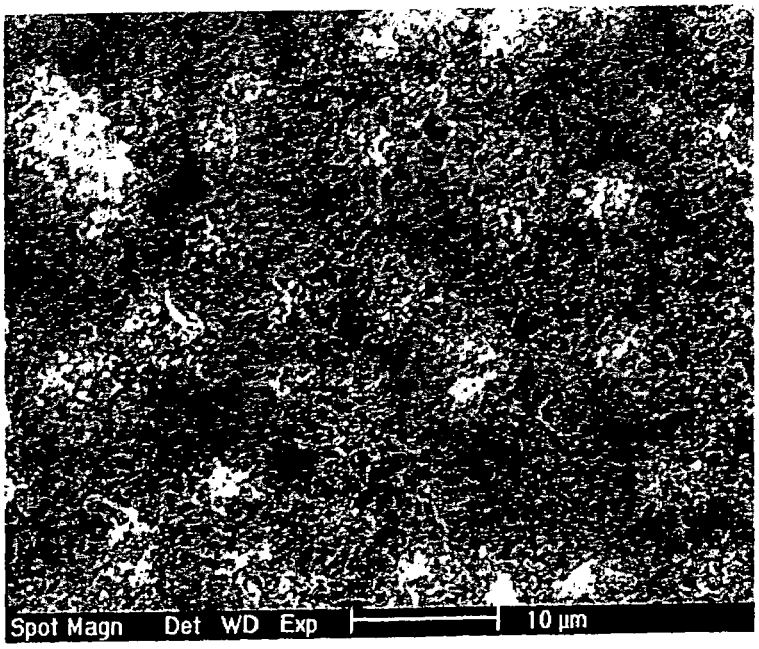
FIG. 6 shows an enlarged view of FIG. 5, more clearly showing the individual nanofibers making up the nanofiber clusters.
Figure 7:
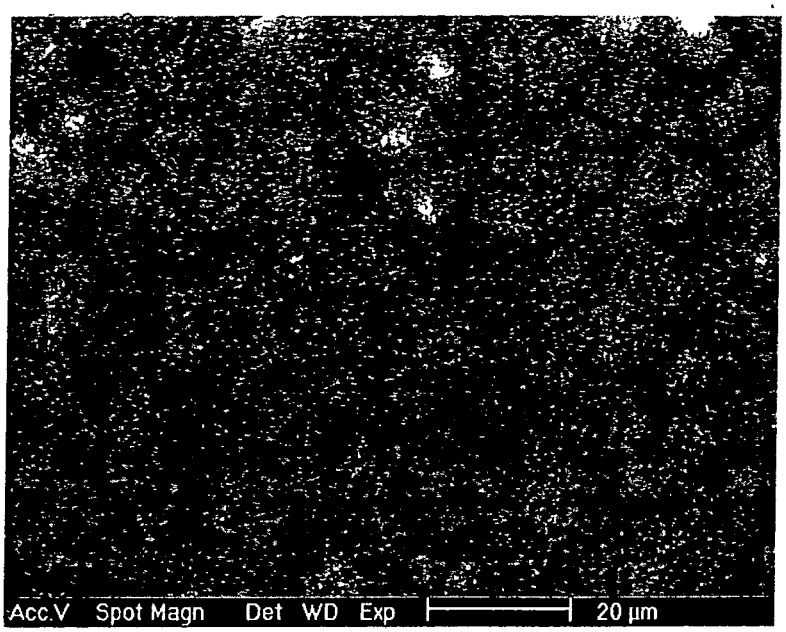
FIG. 7 shows another embodiment having isolated clusters.
Figure 8:
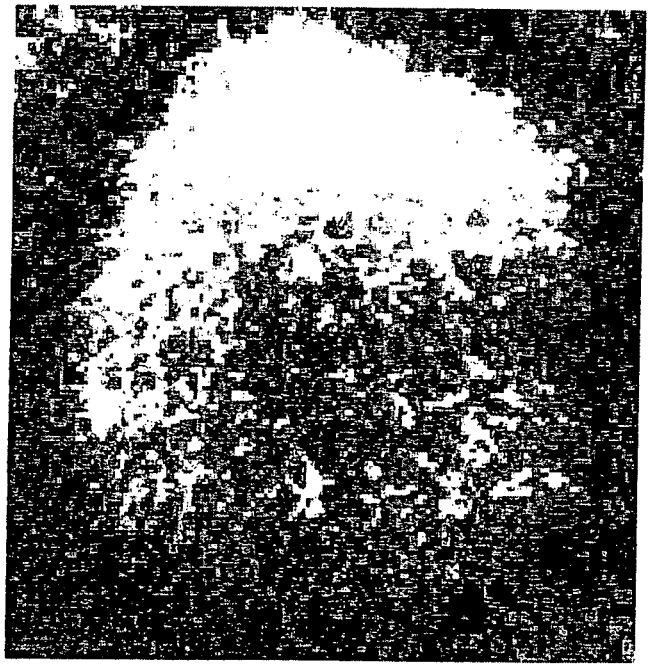
FIG. 8 shows an example of one isolated cluster having a shape similar to a prolate hemispheroid.
Figure 9A:
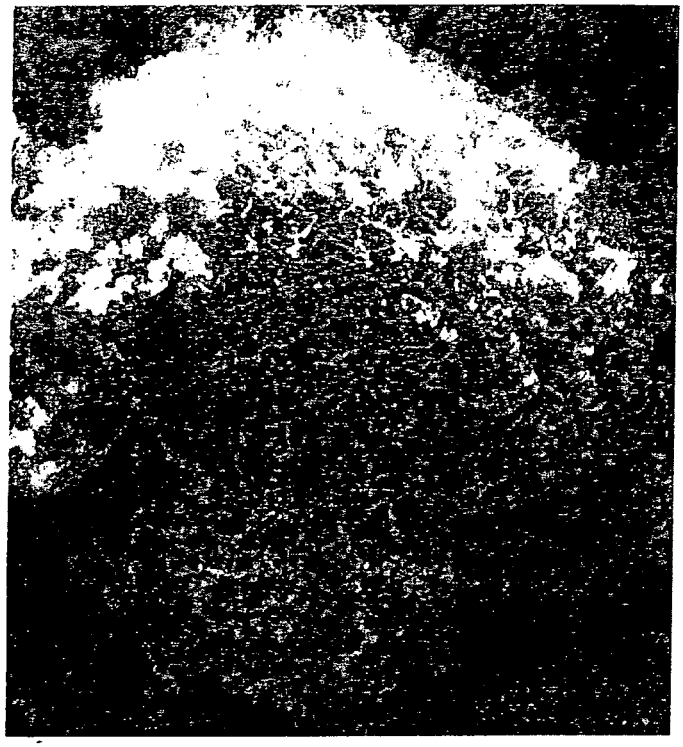
FIG. 9A shows a cluster having the shape of an oblate hemispheroid.
Figure 9B:
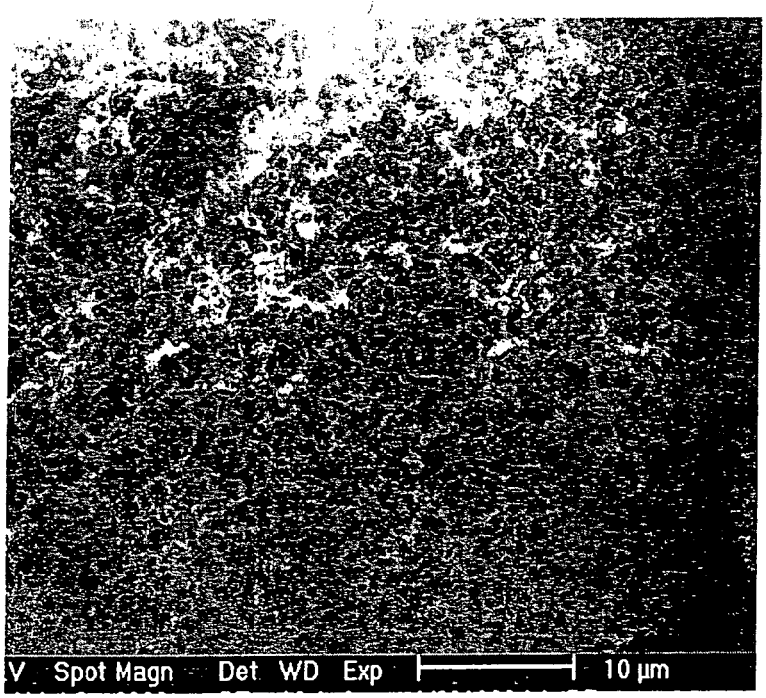
FIG. 9B shows a close-up of the oblate hemispheroid cluster showing individual carbon nanofibers.

The carbon nanofiber clusters using starch particles showed excellent adhesion, were uniformly dispersed across the surface, had good uniformity in size and height and a good density per unit surface area of the electrode, as shown in FIG. 5 for a mung bean starch, for example. FIG. 6, an enlarged view of the embodiment shown in FIG. 5, more clearly shows the individual carbon nanofibers that form the nanofiber clusters. Another embodiment using a mung bean starch and having isolated carbon nanofiber clusters is shown in FIG. 7. Starch having desirable dimensions is readily available and comparatively inexpensive, such as mung bean starch, corn starch, potato starch, and the like. Upon fabricating a field effect diode, the pixel current density is high, and a field strength threshold of less than 2 V/μm is achieved, as shown in FIG. 11. A large current density with comparatively low voltage makes the electron emitting surface energy efficient, as well.

In a preferred embodiment, ethyl cellulose is used as a binder and thickener in combination with terpineol, a solvent and thinner, to prepare a printable paste. Alternatively, a combination of terpineol and ethanol are used as the solvent. Preferably, 5–18 wt. % of ethyl cellulose is added to terpineol to form a printable paste. Other combinations of binders and solvents may replace ethyl cellulose and terpineol; however, a binder and solvent combination should be tailored for dissolving the catalyst precursors, such as nickel and/or iron compounds, and dispersing an organic and/or inorganic non-catalytic particulate within a slurry or paste capable of being deposited on a surface of a conductive substrate. Alternatively, nanoscale nickel and iron catalyst particulates may be suspended in a slurry or paste that is tailored to bind the nanoscale catalyst particles to larger non-catalytic particles and/or non-catalytic particle clusters.

In one embodiment, nickel (II) nitrate hexahydrate, $Ni(NO_3)_2\ 6(H_2O)$ and/or iron (III) nitrate nonahydrate, $Fe(NO_3)_3\ 9(H_2O)$ are dissolved in ethanol. Enough ethanol to completely dissolve the nickel and iron catalyst compounds is preferred. Preferably, the ethanol is pure, having less than 0.1% water. In one embodiment, particulates of a starch are added to the catalyst solution before the catalyst solution is mixed with a paste of terpineol and a cellulose. Alternatively, starch is added to an alcohol, preferably ethanol, and then mixed with the catalyst solution. In another alternative, the catalyst solution is first mixed with the terpineol/ethyl cellulose paste and then the starch is added to the combined catalyst paste. In another embodiment, after particulates of a starch are precipitated with catalysts in a catalyst solution and are filtered, they are mixed with the paste of binder and solvent. In yet another alternative, the metal nitrates and the starch particulates form a paste in a solvent, and then the combined paste is mixed to the terpineol and ethyl cellulose paste. In a further alternative, the metal nitrates, water and starch form a solution firstly, and then the solution is dried by means of, for example, heating or spraying, forming a secondary particulate pregnated with catalyst, and finally the secondary particulates are mixed with a binder-solvent paste.

The particulates of starch are non-catalytic and serve as a surface for the precipitation of the catalyst during processing. By non-catalytic, it is meant that the purpose of the starch is not to catalyze the growth of nanofibers. Preferably, the particulates form catalyst clusters. The catalyst clusters form, for example, by the addition of the starch particles before the catalyst paste is deposited on the surface of the conductive substrate. In a preferred embodiment, ethyl cellulose binds precipitating iron/nickel catalyst compounds to the starch particulates, which form particle clusters of non-catalyzing particulates decorated with iron/nickel catalyst precipitates. The individual precipitate size can be selected to have an average cross-sectional area and distribution of cross-sectional areas that grow nanofibers of a particular average cylindrical diameter and distribution.

The length of the nanofibers is controlled by the CVD process, which can be terminated when a desired length is reached. The mixture of hydrogen in the CVD atmosphere is used to keep the catalyzing precipitates active for nanofiber growth, for example. The gaseous mixture and temperature may be selected to grow single-walled nanotubes or multi-walled nanotubes or other non-tubular nanofibers, for example. Preferably, the nanofibers are "clean" meaning that the surfaces of nanofibers have insignificant amounts of carbon black particles. In one embodiment, clean nanofibers are grown that comprise hemispheroidal fibrous clusters having a mean major axis dimension no greater than 1000 times the mean outer cylindrical diameter of the nanofibers, preferably in a range from 50 to 100 times the mean outer cylindrical diameter.

In one embodiment, "clean" carbon nanofiber clusters are further processed. For example, it is known that carbon nanofibers can be converted to nanofibers of other materials, such as a silicon carbide, a titanium carbide, a niobium carbide, an iron carbide, a boron carbide. In one specific embodiment, carbon nanofiber clusters are grown, and then further processing steps react the carbon nanofibers with silica by vaporizing silica in a stream of inert gas, such as argon, to form SiC nanofiber clusters having a morphology similar to the carbon nanofiber clusters. Substrates and electrodes supporting silicon carbide nanotubes may be selected that are capable of surviving processing conditions, such as processing temperatures of up to 1400° C. High melting point metals, intermetallics and conductive composites are suitable as electrodes, and substrate materials that are stable at the processing temperatures are well known.

It is thought, without being limiting in any way, that nanofiber clusters may be grown that are self-gating, such that the morphologies of the nanofibers and clusters themselves induce efficient field emission characteristics. In addition, a gate can be included that helps to induce field emission from the clusters by conventional means.

EXAMPLES OF EMITTER PREPARATION

The following embodiments are presented merely as specific examples, and the scope of the claims are not to be limited thereto. In the following examples, various processing parameters are adjusted to show the effect of the processing parameters on the capability of being printed, the adhesion of the nanofiber clusters and the I-V characteristics of a field effect device fabricated with the resulting electron emitter.

In each example, unless expressly specified otherwise, a paste or slurry is made comprising at least a catalyst solution having a catalyst-nitrate compound or catalyst salt capable of dissolving in ethanol and an ethanol solvent, such as nickel hexahydrate for nickel and iron nonahydrate for iron; an ethyl cellulose binder; and a terpineol solvent for resolving the binder and for thinning the paste or slurry. The metal catalyst ions are dispersible. Some of the examples further comprise starch particulates, which are either added to the catalyst solution before mixing the catalyst solution with the ethyl cellulose/terpineol paste or added to the ethyl cellulose/terpineol paste after the catalyst solution is added to the ethyl cellulose/terpineol paste.

Many variations in parameters are possible during the chemical vapor deposition of the nanofibers and during fabrication of the field emission device. However, the deposition process of the catalyst precursors, the chemical vapor deposition process and the method of fabrication of the field emission device was kept constant in several examples, allowing a direct comparison of the different catalyst precursors.

The catalyst precursor deposition process comprised screen printing of the catalyst paste or slurry on a clean aluminum electrode surface. Then, the terpineol and/or any remaining ethanol solvents are evaporated during a drying step. Next, a thermal pretreating step first oxidizes the metal catalyst or catalysts in air and then reduces the metal oxides in hydrogen.

Specifically, the thermal pretreating step comprises heating the substrate, aluminum electrode and catalyst precursor to a temperature greater than 500° C. in air. The temperature is maintained between 500° C. and 550° C., which is less than the softening temperature of the glass substrate used in these examples. The heating is continued for a duration sufficient to vaporize any remaining solvent, burn off substantial amounts of the starch particulates and the ethyl cellulose binder and oxidize the catalyst precursor to oxide. It is believed, without being limiting in any way, that chemical changes and diffusion during this heating step commences formation of an adhesion layer between the precursor clusters and the aluminum layer. Next, the step of reducing the oxides uses the same temperature range of 500–550° C., but replaces the oxidizing atmosphere with hydrogen, which reduces the oxide, activating catalytic, metal nanoparticulate clusters.

Next, carbon nanofibers are grown from the nanoparticulate clusters by catalytic chemical vapor deposition at 550° C. in a flow of gas comprising 10 vol % acetylene, 45 vol % hydrogen and 45 vol % argon in a tubular reactor within an annular furnace. The growth of carbon nanofibers is monitored and terminated within a few minutes, when sufficient nanofiber growth has occurred to form nanofiber clusters, as shown in FIGS. 1–9. The comparatively short time required for catalytic growth using this specific process is advantageous, because the process throughput is greater than some other methods, reducing the cost of fabrication and increasing the commercial competitiveness of the ultimate field emission device. Meanwhile, formation of carbon black can be greatly reduced. In the specific process described here, the carbon nanofibers form clusters of multi-walled carbon nanotubes and non-tubular nanofibers. In some examples, the clusters are firmly adhered to the aluminum electrode by an adhesion layer.

Figure 16A:
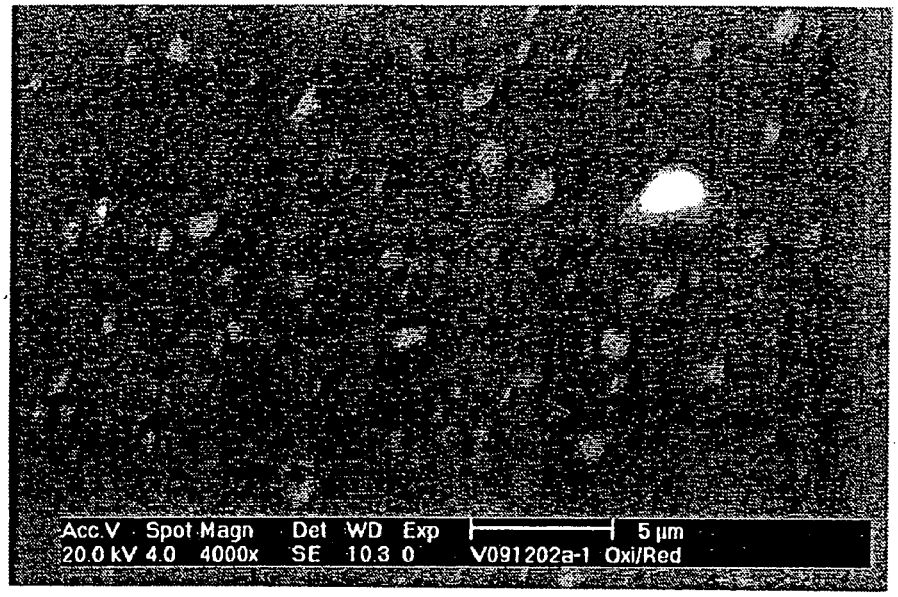
FIGS. 16A and 16B show a pretreated cathode, according to the present invention before (16A) and after (16B) CVD growth.
Figure 16B:
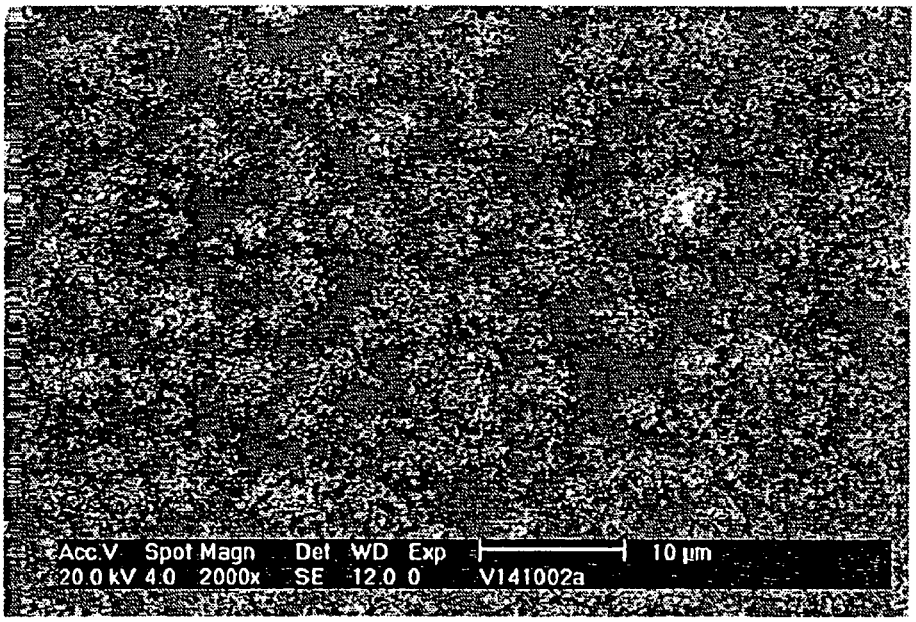
Figure 17A:
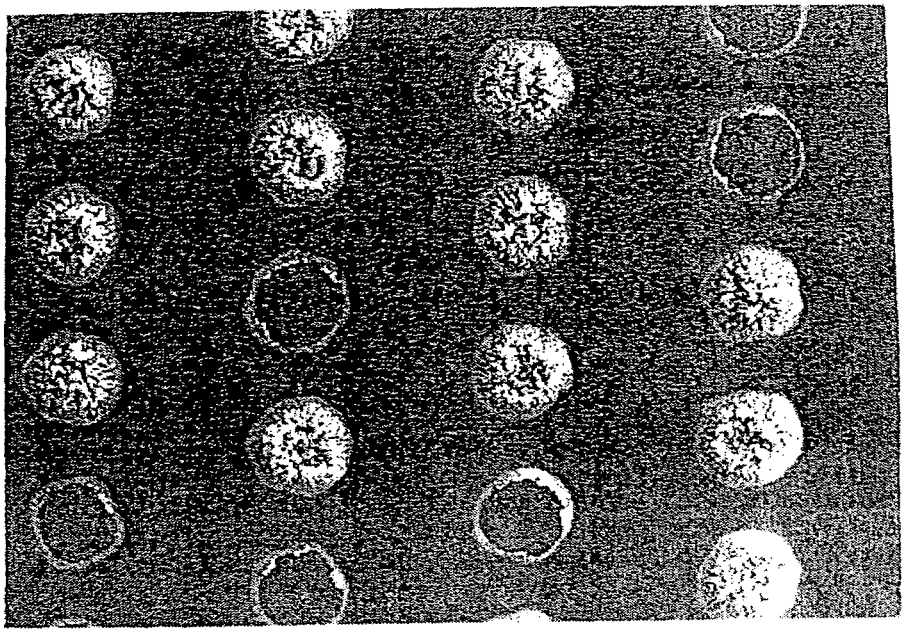
FIG. 17A shows an example of carbon nanofibers with poor adhesion with missing pixels after exposure to forced air.
Figure 17B:
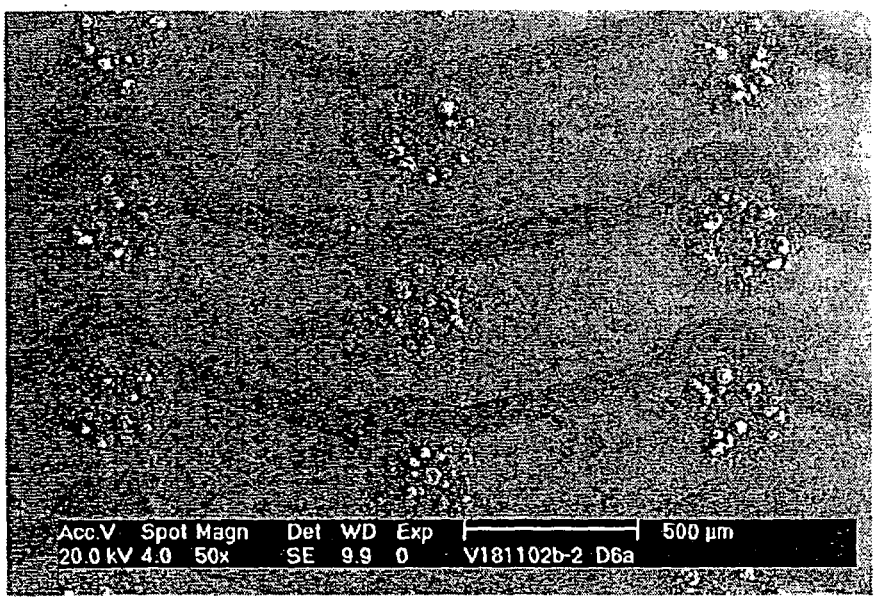
FIG. 17B shows one embodiment of the invention having excellent adhesion.
Figure 18:
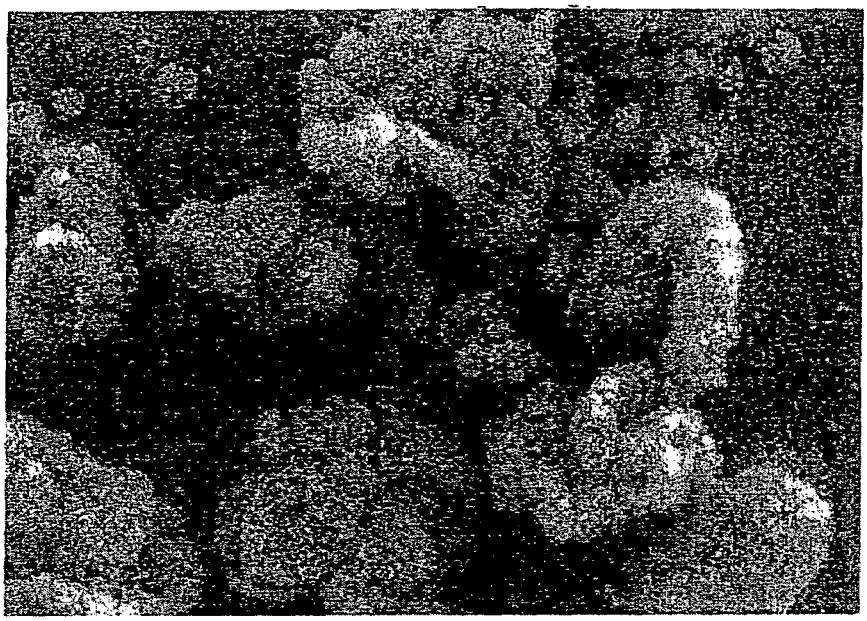
FIG. 18 shows an embodiment having an inhomogeneous growth of carbon nonofibers.
Figure 19:
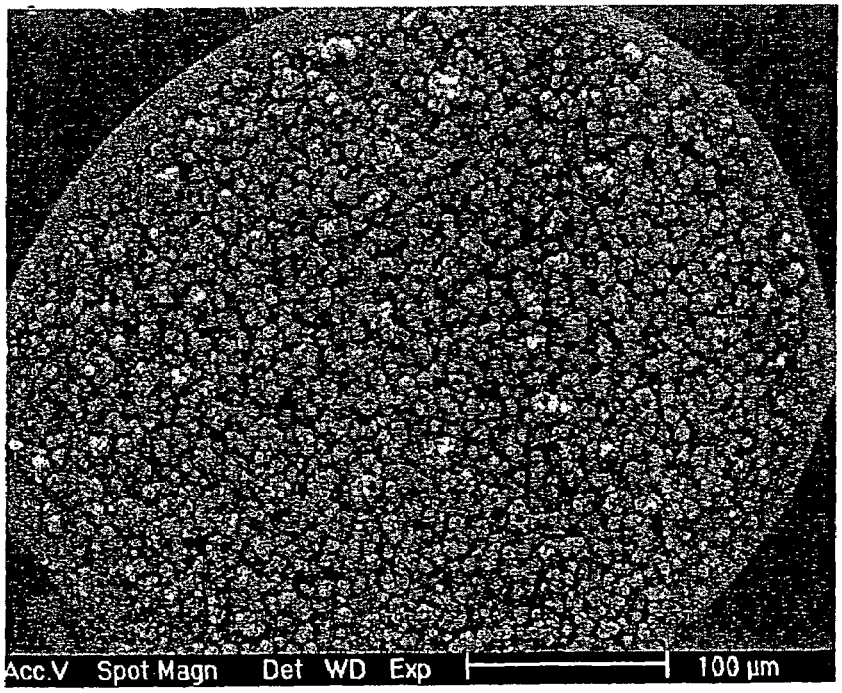
FIG. 19 shows a pixel of one embodiment having good adhesion and isolated carbon nanofiber cluster.

For example, a sketch of a field emission device is presented in FIGS. 16A and 16B. The electron emitter 162 comprises an electrode 166 and a plurality of nanofiber clusters 164. For example, the nanofiber clusters 164 are graphitic carbon nanofibers, silicon carbide nanofibers or other electron emitting nanofibers, such as metal nanowires, metal oxide nanofibers, metal sulfide nanofibers and other nanofibers made of compounds such as gallium nitride, boron nitride, boron carbide nitride, silicon and silicon carbide. Electron emitters 162 are adhered to a substrate 170, forming the cathode side of the field emission device 160. A spacing frame 172 separates the cathode side 173 from the anode side 175. The anode side 175 of the field emission device 160 comprises a thin metallic layer 168, a phosphorescent or fluorescent layer or layers 174, a conductive electrode 176 and a transparent substrate 178. The electrode 176 may be a transparent layer, such as Indian tin oxide or another transparent conductive material and the electrode 176 may be patterned to correspond to the pattern of electron emitters 162. The frame 172 separating the cathode side 173 from the anode side 175 comprises at least one framing element 171 that is capable of sealing the space between the cathode side 173 and the anode side 175, such that the space between the cathode 173 and the anode side 175 may be evacuated. Each of the electrodes 166 may be connected in an electronic circuit (not shown) by wire traces 161, a portion of which is shown in FIG. 16B.

Example 1

A catalyst paste comprises nickel, ethyl cellulose binder terpineol and alcohol. Specifically, from 5 to 18 wt % of ethyl cellulose was resolved in 100 milliliters of terpineol, and from 0.01 to 1 wt % of nickel was added to the mixture to form a paste. Then, from 1 to 10 vol % of alcohol, e.g. ethanol, was added to the paste. Excellent printing characteristics were observed during screen printing of the catalyst paste. An area of 65 square centimeters was covered with the catalyst paste and at least 30% to 60% of the area was observed as emitting light after processing and incorporation of the cathode into a field effect light emitting device. The characteristic I-V curve had a field strength threshold and current limits similar to that for Example 3.

Example 2

Figure 10:
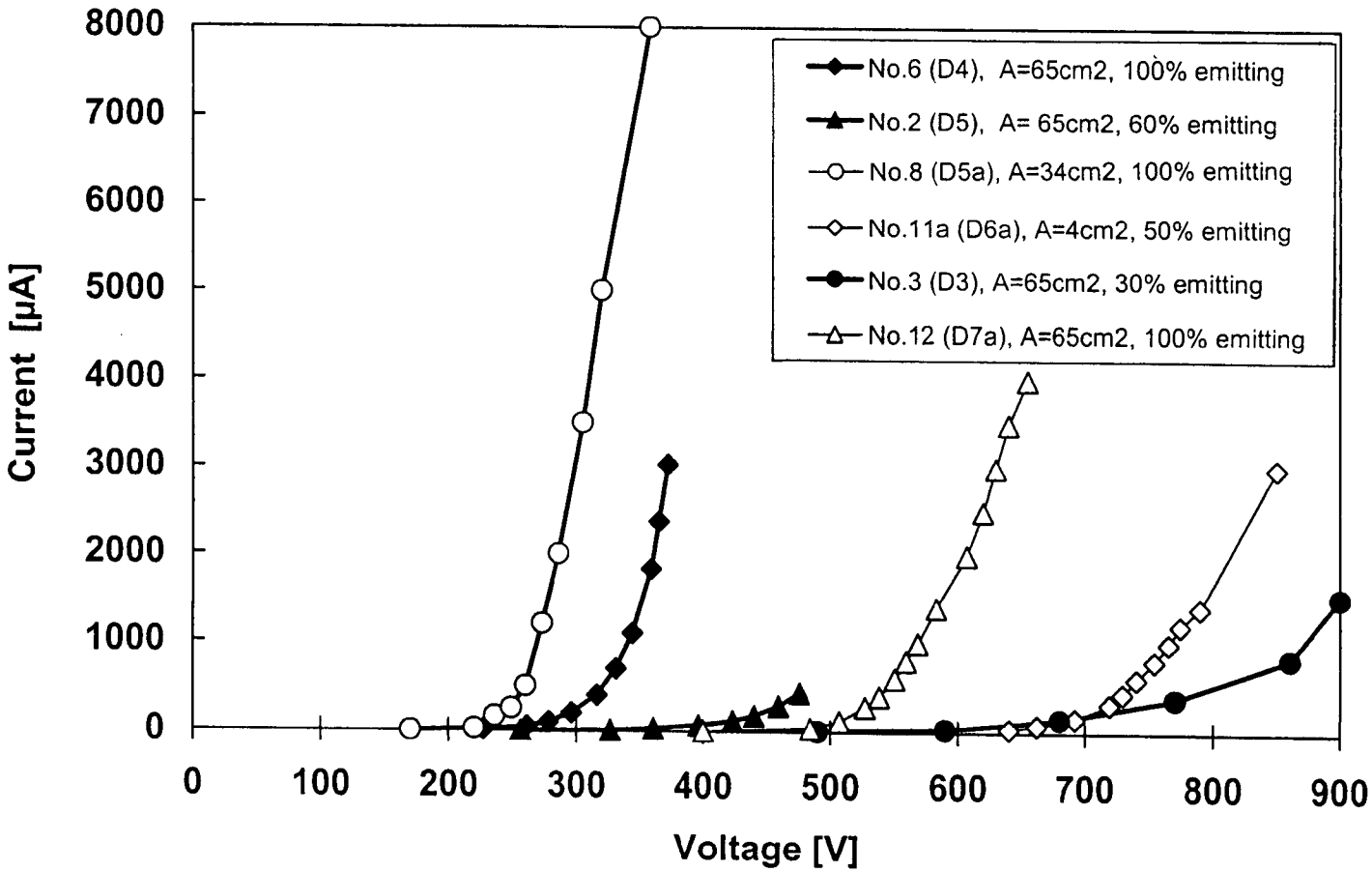
FIG. 10 shows a graph of the current versus voltage for several examples.

A catalyst paste (D5) was made by mixing 10 wt % ethyl cellulose with 100 milliliters of terpineol. Then, 0.1 wt % of nickel and 0.1 wt % of iron were dissolved in an amount of alcohol equal to 10 vol. % of the ethyl cellulose and terpineol paste. The catalyst solution was then added to the paste and mixed at a temperature of 60° C. forming an homogeneous printable catalyst paste. After printing the paste on an aluminum film, pretreating thermally in air and hydrogen, and processing the paste to form carbon nanofibers by chemical vapor deprivation, a light emitting field emission diode was produced. About 60% of the surface area of the diode was light emitting, and the I-V characteristics of the resulting device are shown in FIG. 10.

Example 3

A catalyst paste (D3) was prepared using a nickel nitrate dissolved in alcohol mixed in a paste of 10 wt % ethyl cellulose in 100 milliliters of terpineol. The 5 vol % solution of alcohol and nickel nitrate was added and mixed at a temperature of 60° C. The paste was printed on an aluminum film, pretreated thermally in air and hydrogen and processed by chemical vapor deposition to form 100 nm average diameter and 5–10 μm length carbon nanofibers. Then, a field emission diode was fabricated using the carbon nanofibers as the cathode, and at least 30 to 60% of the anodic, phosphorescent area was light emitting.

Example 4

In this example, the ethyl cellulose/terpineol was replaced by PVA/water. Satisfactory screen printing was not achieved, and no device was fabricated.

Example 5

In this example, terpineol was replaced by ethanol only. Satisfactory screen printing was not achieved, and no device was fabricated.

Example 6

A catalyst paste (D4) comprised 10 wt % ethyl cellulose binder and 0.06 wt % of nickel and 0.06 wt % of iron. Nickel nitrate and iron nitrate dissolved in ethanol. 6 vol % of the catalyst solution was added to the ethyl cellulose and terpineol paste and mixed at 60° C. It is believed that at least a portion of the ethanol vaporized during mixing. This paste was printed on the surface of an aluminum electrode on glass substrate and used to fabricate a field emission diode. The entire anode area (65 $cm^2$) was light emitting, and the I-V characteristics are shown in FIG. 10. The improved synergistic results are attributed to the combination of nickel and iron catalysts in the paste. The formation of nickel/iron catalyst clusters is preferable to either nickel or iron alone.

Example 7

In this example, water replaced ethyl cellulose/terpineol. Satisfactory screen printing was not achieved, and no device was fabricated.

Example 8

Figure 12A:
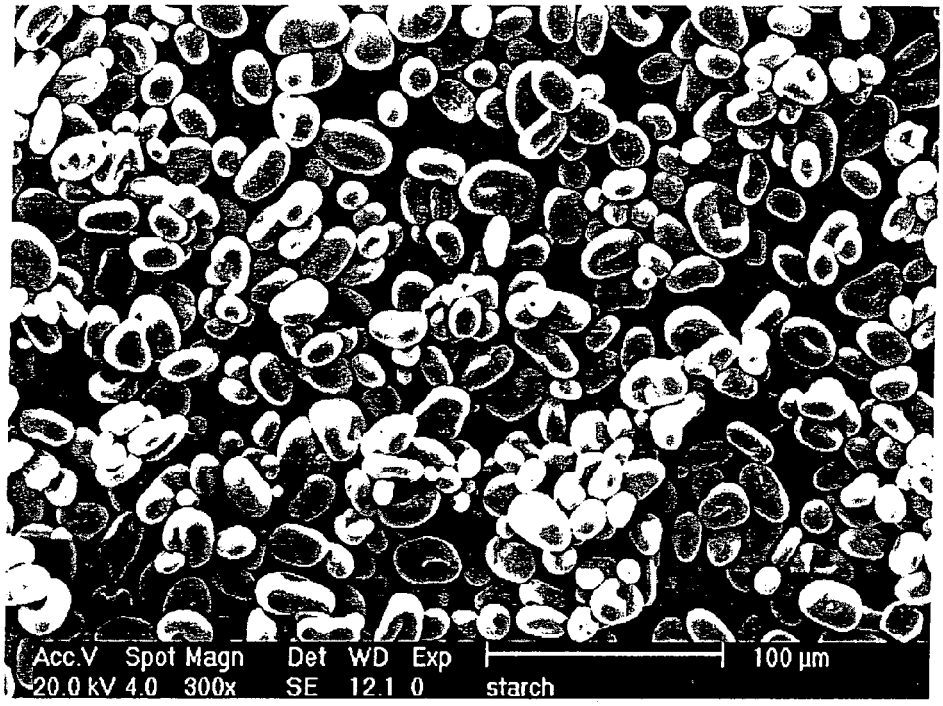
FIGS. 12A and 12B show magnified images of mung bean.
Figure 12B:
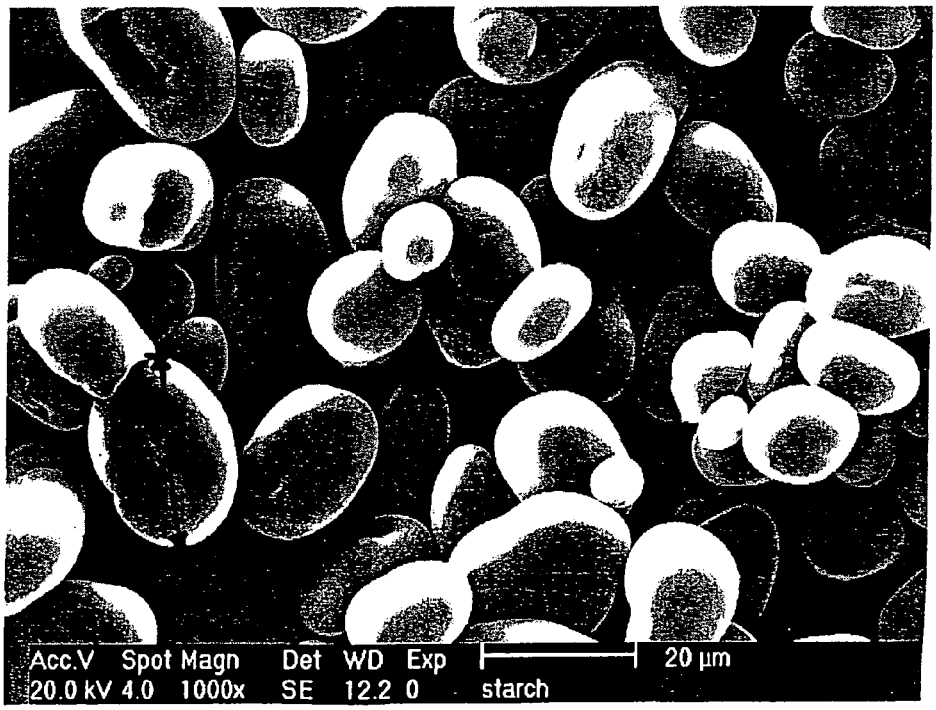
Figure 13A:
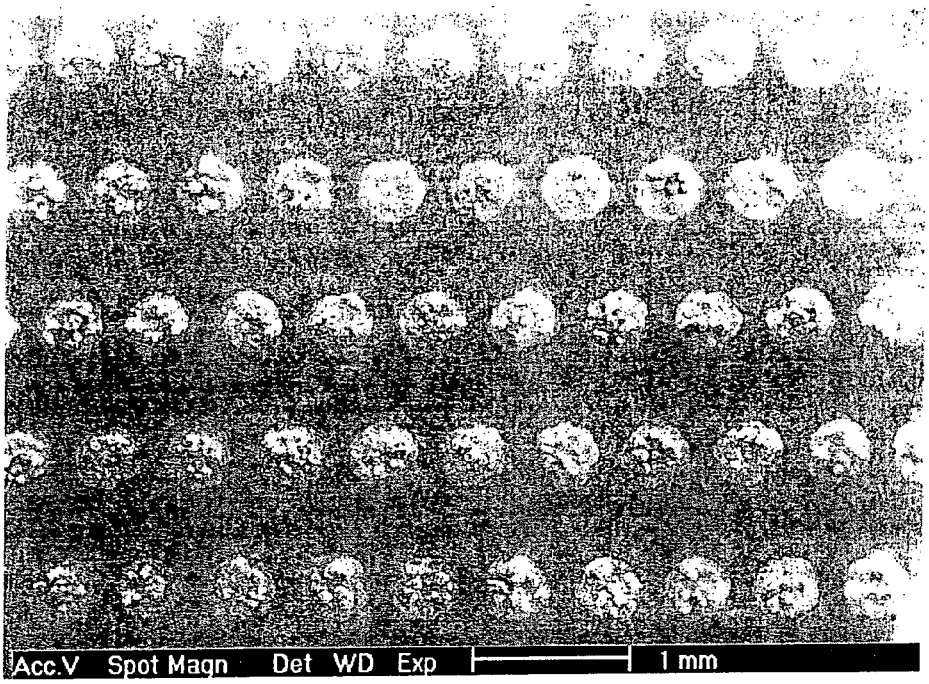
FIGS. 13A–13E show magnified images of the electrode of Example 12.
Figure 13B:
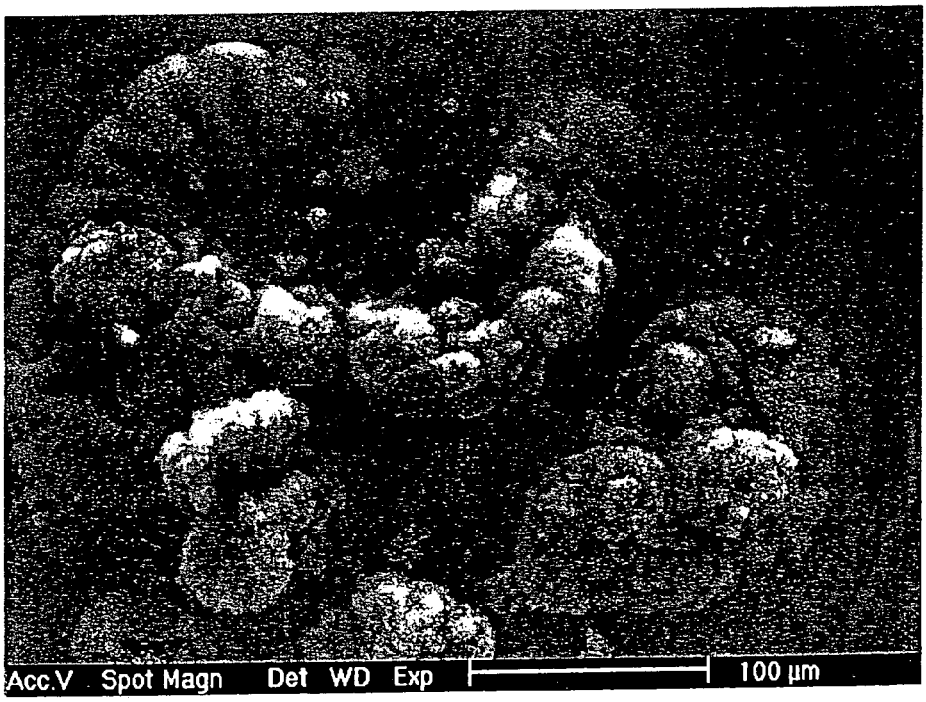
Figure 13C:
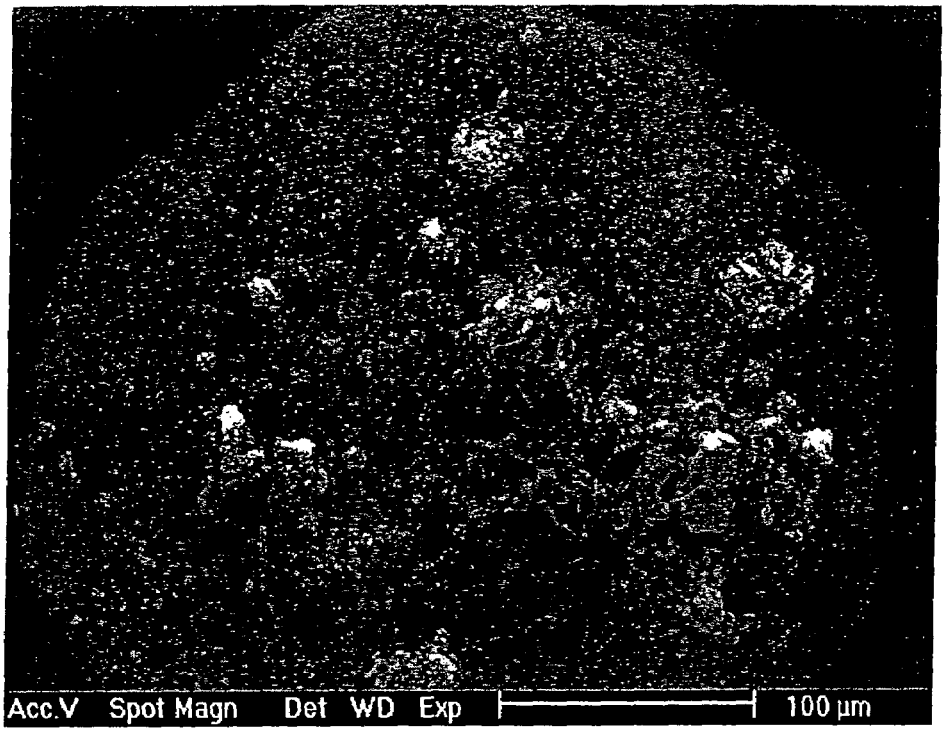
Figure 13D:
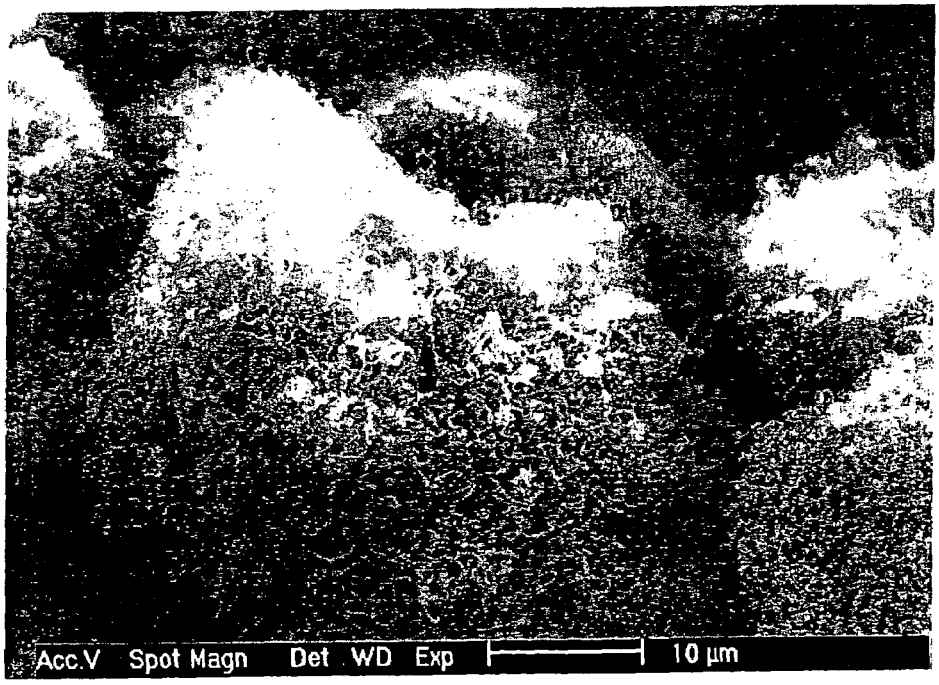
Figure 13E:
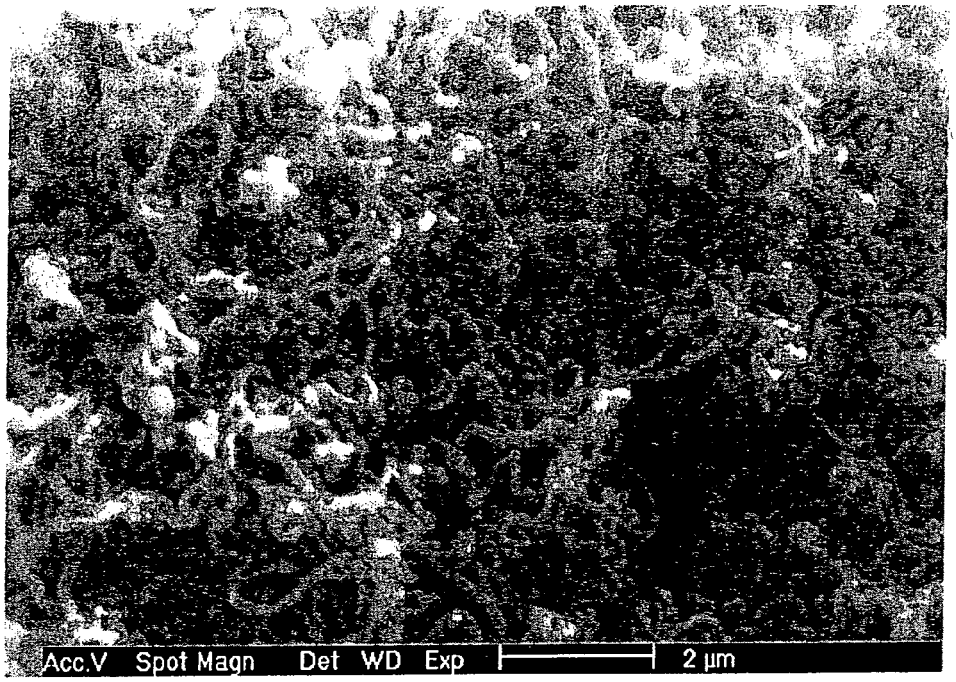
Figure 14A:
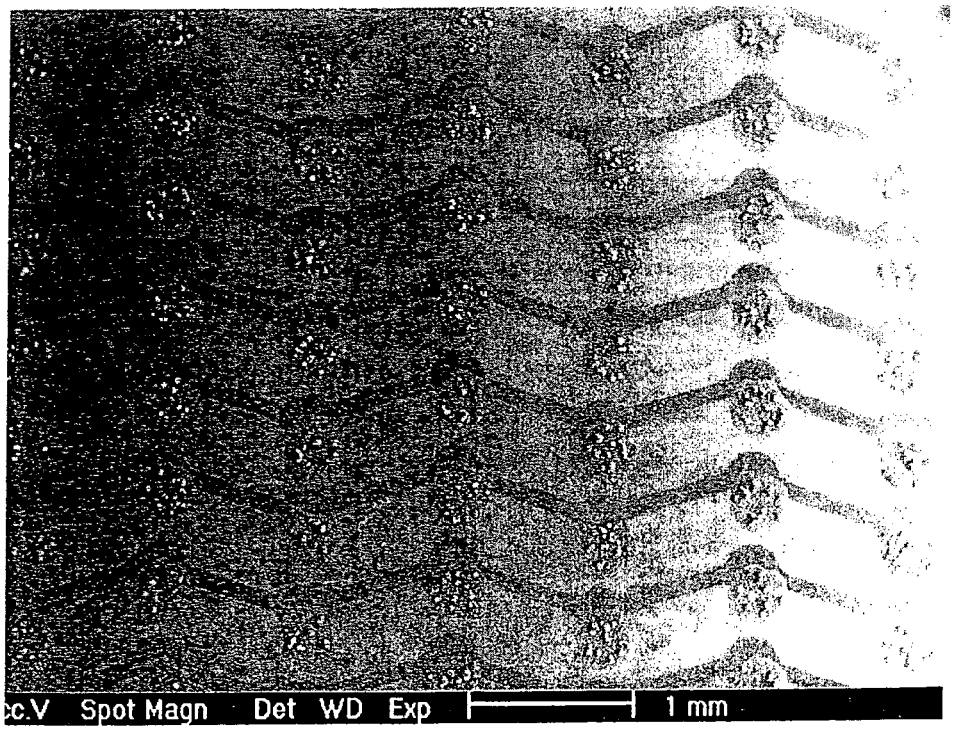
FIGS. 14A–14E show magnified images of the electrode of Example 11A.
Figure 14B:
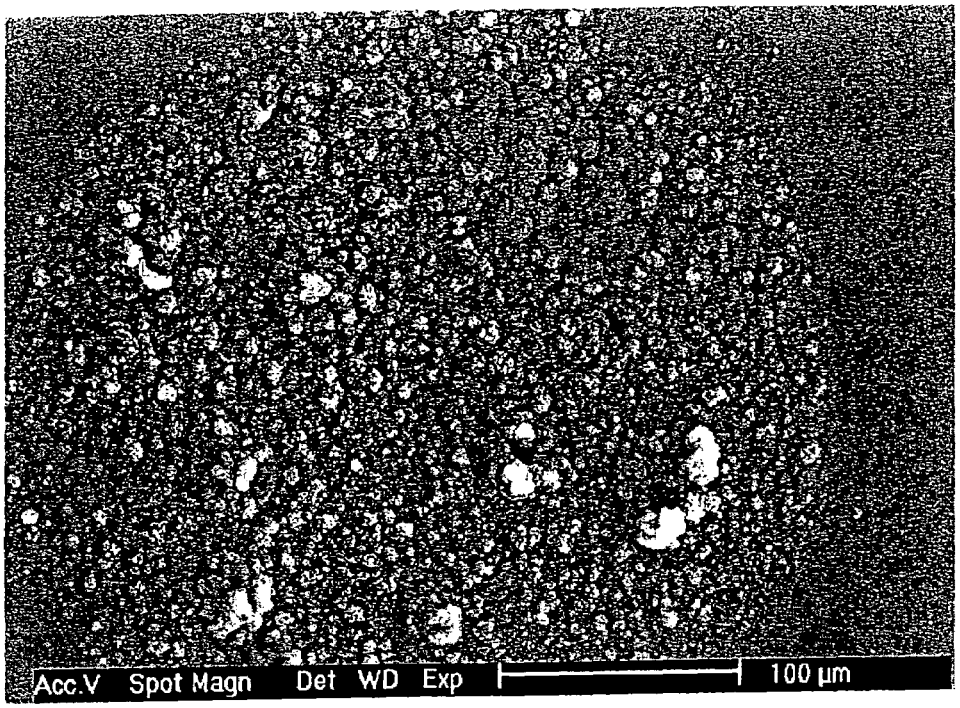
Figure 14C:
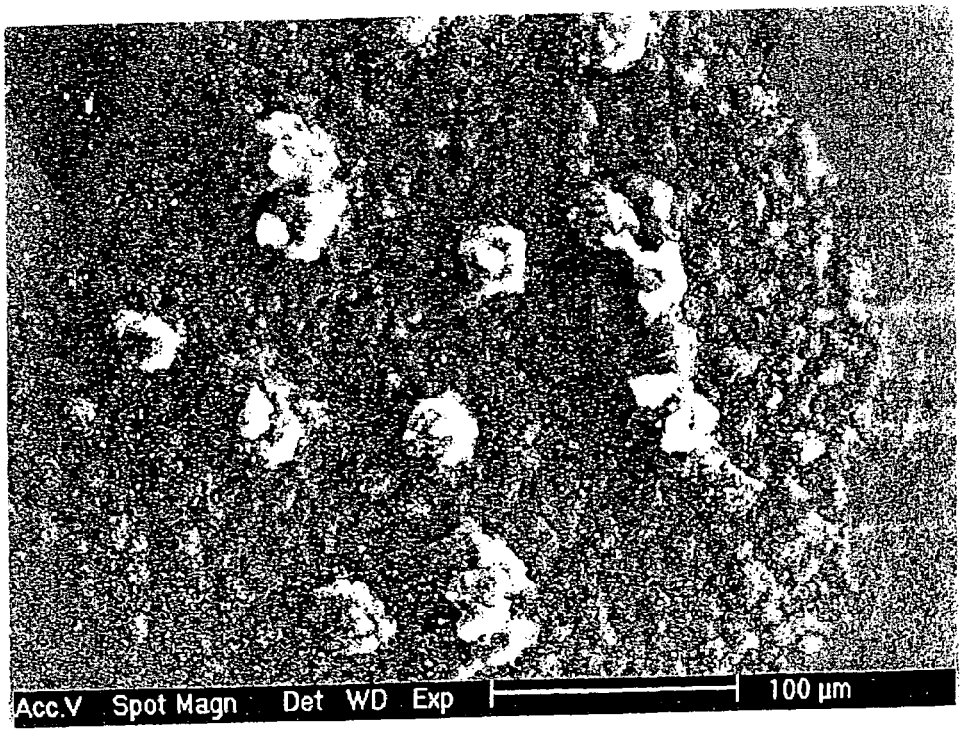
Figure 14D:
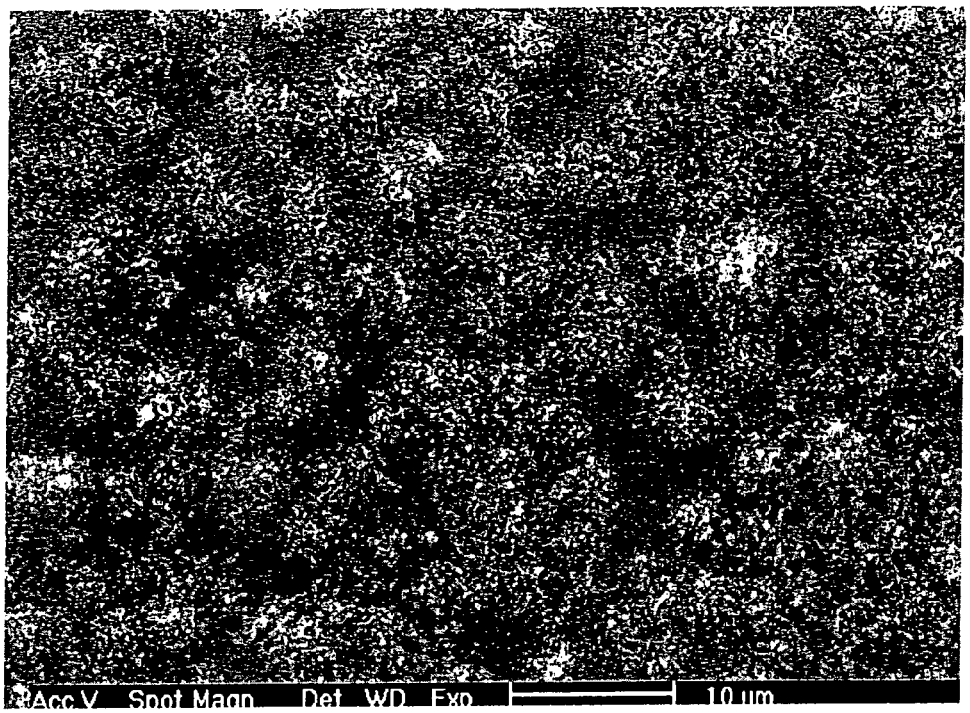
Figure 14E:
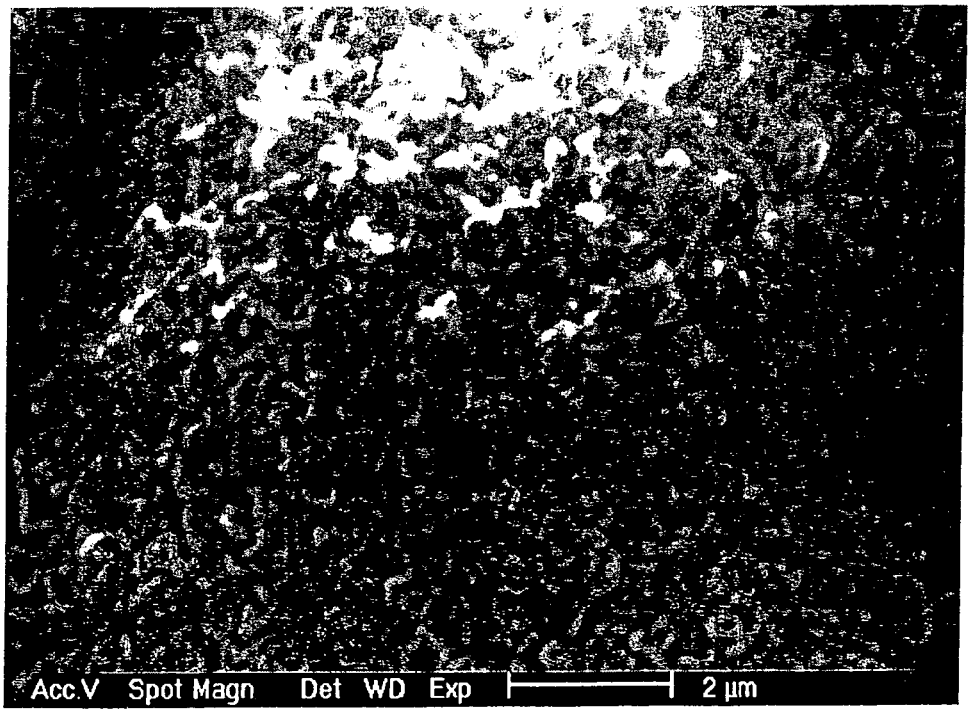
Figure 15A:
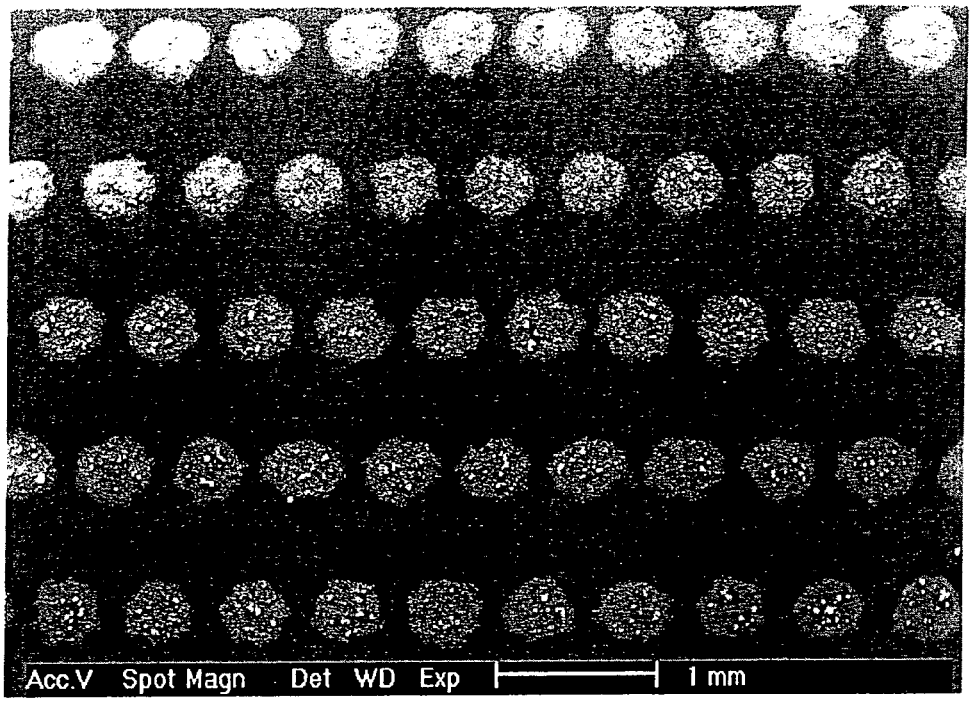
FIGS. 15A–15E show magnified images of the electrode of Example 8.
Figure 15B:
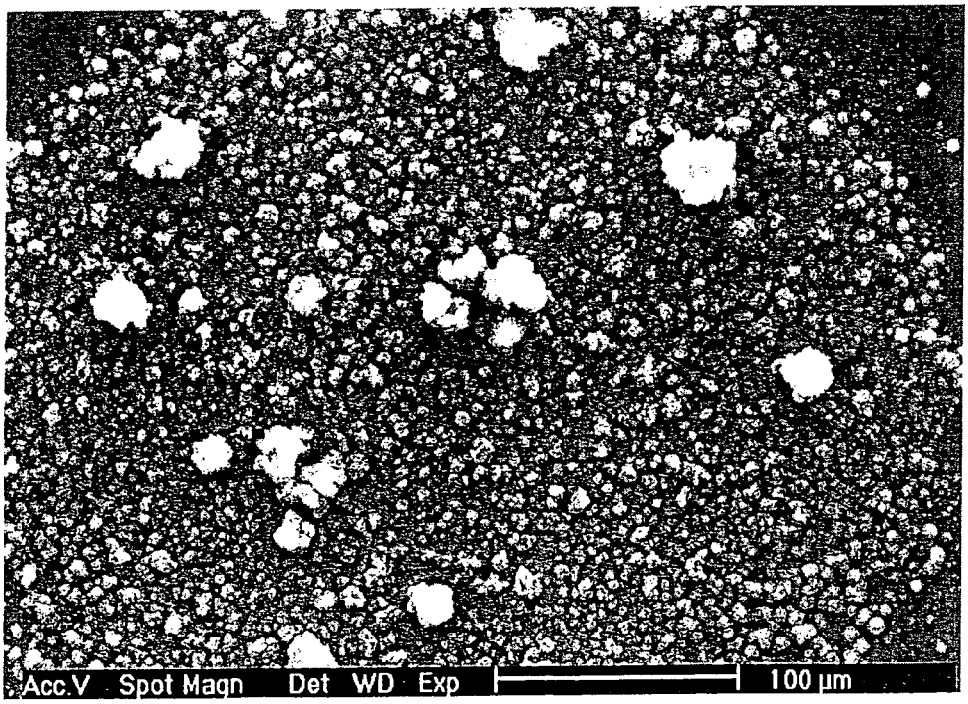
Figure 15C:
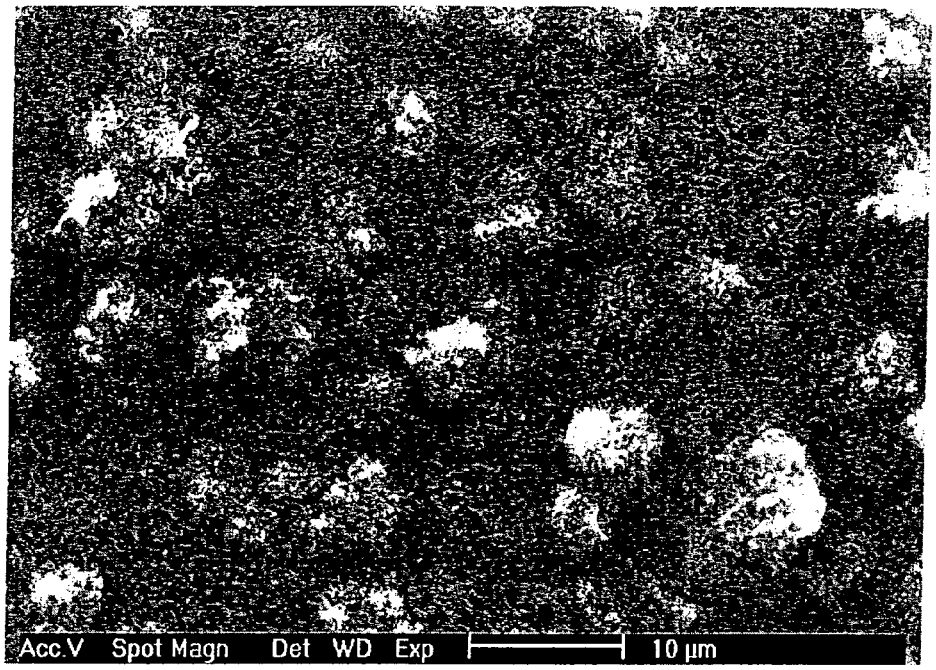
Figure 15D:
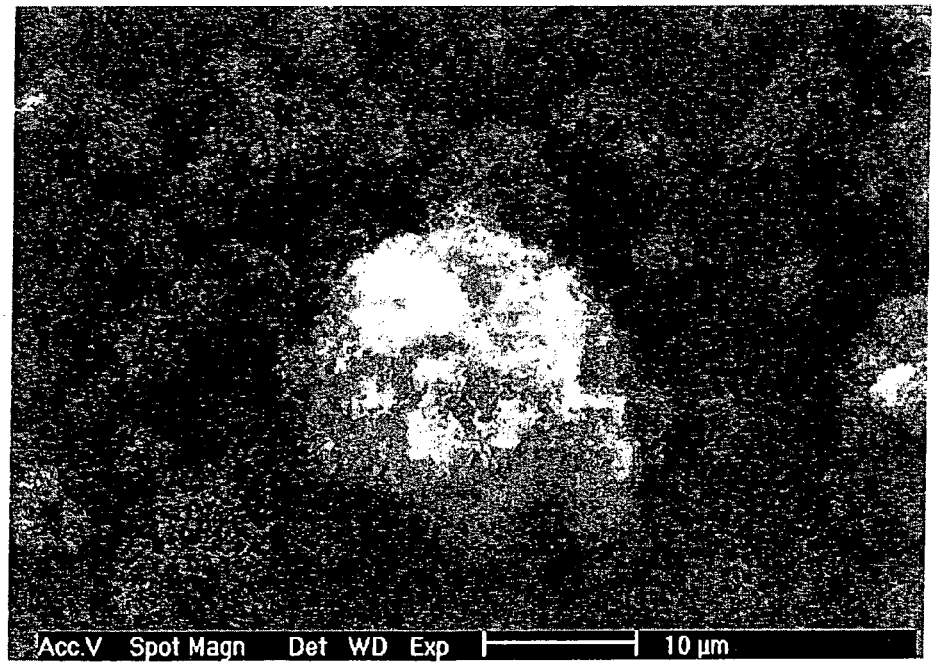
Figure 15E:
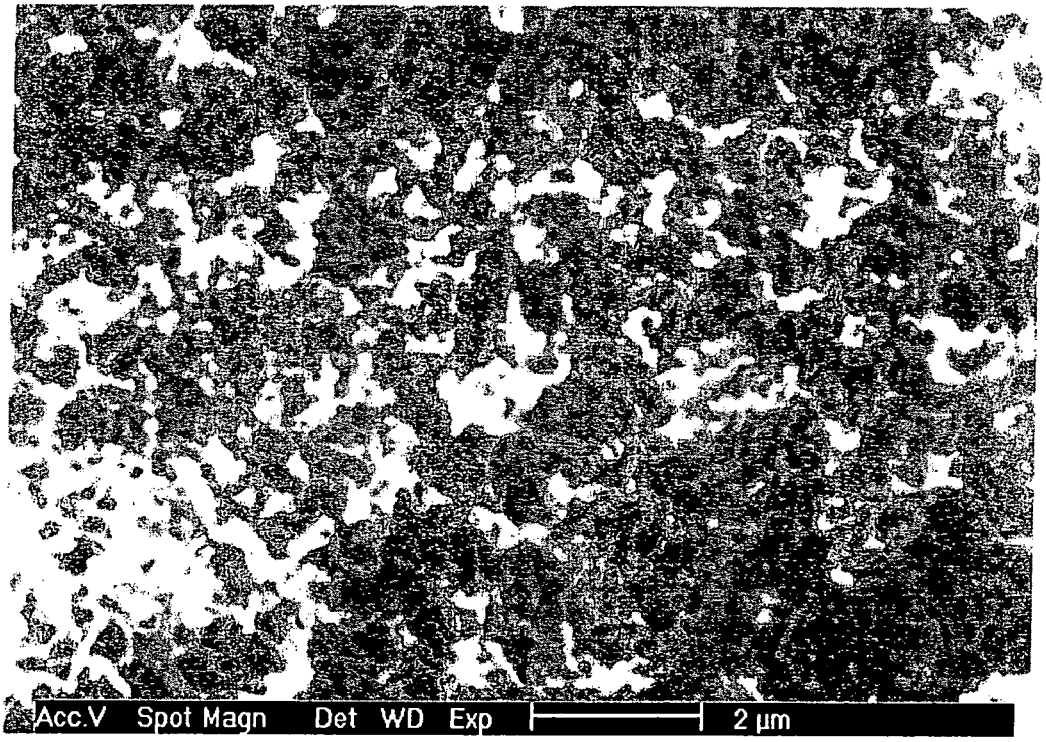

A catalyst paste (D5A) was produced using the same process as the catalyst paste D5 used in Example 2, except 1 wt % of mung bean starch was added to the alcohol catalyst solution prior to mixing the alcohol catalyst solution with the ethyl cellulose and terpineol paste. The starch provided organic particulates as shown in FIGS. 12 and 13 having a mean maximum lineal dimension, e.g. the largest distance between any two points on the surface, in a range from about 5 μm to about 20 μm. A field emission diode was fabricated using the carbon nanofibers grown from this catalyst paste as the cathode, and the entire anode area (34 $cm^2$) was light emitting. A low field strength threshold, 1.5 V/μm, was obtained.

Example 9

In this example, the nickel nitrate of Example 3 was replaced with an iron nitrate. Screen printing produced a desirable uniformity in dispersion of the catalyst on the aluminum surface. The emission characteristics were similar to Example 3, using nickel nitrate alone.

Example 10

A catalyst paste (D9A) was prepared using the same process as Example 6, except that 0.2 wt % iron was dissolved in alcohol before adding 20 vol % of the catalyst solution to the paste. The pixels lacked sufficient adhesion to the aluminum, resulting in detachment under compressed air, as shown in FIG. 2A.

Example 11A

Example 8 was repeated, except that the catalyst paste (D6A) comprised 0.16 wt % iron instead of 0.1 wt % iron and 3 wt % starch rather than 1 wt % starch. Excellent printing characteristics and adhesion were achieved. An area of 4 $cm^2$ was deposited and 50% of the area was emitting. A current density of 2.7 $mA/cm^2$ at electrical field 4.25 V/μm was obtained. The field strength threshold was less than 3.5 V/μm and the maximum current density was the greatest of any of the Examples, as shown in FIG. 11.

Example 12

Example 8 was repeated again, except that 0.08 wt % of nickel, 0.082 wt % of iron and 5 wt % mung bean starch were added directly to the ethyl cellulose/terpineol paste without using ethanol as a solvent. Inhomogeneous growth of irregular topological features are evident in FIGS. 13A–13E.

A field emission device is achieved in some examples having pixels comprised of isolated clusters that adhere to a conductive electrode. The resulting current density of a field emissive device may be greater than 200 $\mu A/cm^2$, and the field strength threshold may be less than 2 V/μm. It is believed that screening effects are reduced by the morphology of the entangled nanofiber clusters and by isolating clusters by a distance greater than the distance that an individual nanofiber can extend, which depends on the morphology and entanglement of the nanofibers in a cluster.

In one embodiment, posttreatment of the fibrous clusters, such as hydrogen plasma treatment, exposure to ultraviolet light, laser ablation treatment and/or ion bombardment, may improve the emission characteristics. It is thought that such conventional treatments increase surface defects of nanofibers, increasing the density of emitters.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

TABLE 1

| Backlight Parameters | |
|---|---|
| Property | Value |
| Average Display Luminance | 150 $cd/m^2$ |
| Peak Display Luminance | 800 $cd/m^2$ |

TABLE 1-continued

| Backlight Parameters | |
|---|---|
| Property | Value |
| LC transmission | 4% |
| Average Backlight Luminance | 3,750 $cd/m^2$ |
| Peak Backlight Luminance | 20,000 $cd/m^2$ |
| Average Luminous Flux | 2,800 lm |
| Peak Luminous Flux | 15,000 lm |
| No. CCFLs (375 lm) to generate 15,000 lm | 40 |
| No. CCFLs with 10% duty cycle | 400 |

What is claimed is:

1. A field emission device for use as a backlight in a liquid crystal television comprising:

a plurality of conductive anodes, each anode having a light-emitting layer;

a plurality of electron emitters, the emitters being separated from the plurality of anodes by a spacer, forming a gap, each of the plurality of emitters comprising:

a conductive electrode; and a plurality of fibrous clusters, each of the plurality of fibrous clusters being formed in situ by a chemical vapor deposition process, each of the plurality of fibrous clusters comprising a plurality of nanofibers grown from a catalytic particulate cluster adhered to the conductive electrode by an adhesion layer, the adhesion layer being formed during processing of a catalyst precursor, wherein the composition of the catalyst precursor comprises a catalyst compound, a solvent and a plurality of non-catalytic particles, the composition being selected such that the plurality of non-catalytic particles aggregate into clusters and support particulates of the catalyst compound helping to adhere the particulates to the conductive electrode in the form of catalytic particulate clusters after deposition and processing of the catalyst precursor such that at least a portion of the plurality of fibrous clusters have a hemispheroidal shape; and the plurality of conductive anodes and the conductive electrode is operatively connected to an electronic circuit such that the electronic circuit is capable of controlling the emission of electrons between the plurality of electron emitters and the plurality of anodes.

2. The field emission device of claim 1, wherein the light-emitting layer comprises a mixture of phosphors.

3. The field emission device of claim 1, further comprising a reflective film adhered to the light-emitting layer between the anode and the conductive electrode.

4. The field emission device of claim 3, wherein the reflective film is of aluminum.

5. The field emission device of claim 1, wherein the chemical vapor deposition process and the catalyst compound are selected such that the nanofibers are carbon nanofibers.

6. The field emission device of claim 5, wherein at least a portion of the catalyst compound of the catalyst precursor is dissolved by the solvent such that evaporation of the solvent is capable of causing the solution to precipitate catalyst particulates on the clusters of non-catalytic particles, the amount of catalyst compound, the number and density of non-catalytic particles and the precipitation process controlling the range of sizes of the catalyst particulates that form the catalytic particulate clusters, and the nanofibers having a range of outer cylindrical diameters, the range of outer cylindrical diameters being determined by the chemical vapor deposition process and the range of sizes of the catalyst particulates.

7. The field emission device of claim 5, wherein the range of outer cylindrical diameters of the carbon nanofibers is no greater than 200 nanometers.

8. The field emission device of claim 7, wherein the range of outer cylindrical diameters of the carbon nanofibers is at least 50 nanometers.

9. The field emission device of claim 1, wherein the hemispheroidal shape is one of an oblate hemispheroid and a prolate hemispheroid.

10. The field emission device of claim 9, wherein the hemispheroidal shape is an oblate hemispheroid.

11. The field emission device of claim 5, wherein at least a portion of the carbon nanofibers are comprised of carbon nanotubes.

12. The field emission device of claim 11, wherein the carbon nanotubes are multi-walled carbon nanotubes.

13. The field emission device of claim 12, wherein the outer cylindrical diameter of the multi-walled carbon nanotubes is in a range from 50 nanometers to 200 nanometers.

14. The field emission device of claim 1, wherein the length of the plurality of carbon nanofibers is selected such that the hemispheroidal shape is of entangled nanofibers.

15. The field emission device of claim 1, wherein each of the plurality of fibrous clusters having hemispheroidal shape is isolated from neighboring fibrous clusters having hemispheroidal shape.

16. The field emission device of claim 5, wherein the adhesion layer is formed of one of an intermetallic, a carbide, a nitride and combinations thereof.

17. The field emission device of claim 5, wherein the conductive electrode is comprised of aluminum or an aluminum alloy.

18. The field emission device of claim 5, wherein the fibrous clusters have hemispheroidal shapes with a mean major axis dimension and the nanofibers have a mean outer cylindrical diameter, and the mean major axis dimension is no greater than 1000 times the mean outer cylindrical diameter.

19. The field emission device of claim 5, wherein each of the hemispheroidal shapes of the fibrous clusters have a major axis dimension and the nanofibers have a mean outer cylindrical diameter, and the major axis dimension of each of the fibrous clusters is in a range from 50 to 100 times the mean outer cylindrical diameter.

20. The field emission device of claim 1, wherein the non-catalytic particles are of an organic material.

21. The field emission device of claim 20, wherein the organic material is a starch.

22. The field emission device of claim 21, wherein the starch is a mung starch.

23. The field emission device of claim 1, wherein the non-catalytic particles have a mean maximum lineal dimension of at least 5 micrometers.

24. The field emission device of claim 23, wherein the non-catalytic particles have a mean maximum lineal dimension of no greater than 20 micrometers.

25. The field emission device of claim 1, wherein the pattern is one of evenly dispersed fibrous clusters.

26. The field emission device of claim 25, wherein the fibrous clusters are uniformly sized.

27. The field emission device of claim 1, wherein the light-emitting layer comprises a mixture of phosphors such that the light-emitting layer emits light of a predetermined color.

28. The field emission device of claim 1, wherein the electronic circuit scrolls the anodes such that each of the plurality of emitters emits electrons for a duty cycle of no greater than 20 percent.

29. The field emission device of claim 1, wherein the electronic circuit scrolls the anodes such that each of the plurality of emitters emits electrons for a duty cycle of no greater than 10 percent.

30. The field emission device of claim 1, wherein the electronic circuit includes a triode structure such that the electronic circuit is capable of both scrolling the plurality of anodes and varying the intensity of each of the plurality of anodes.

31. The field emission device of claim 1, wherein the threshold field strength of the field emission device is no greater than 3.5 volts.

32. The field emission device of claim 1, wherein the threshold field strength of the field emission device is no greater than 2 volts.

33. The field emission device of claim 1, wherein the threshold field strength of the field emission device is in a range from at least 1 volt to no greater than 3.5 volts.

34. The field emission device of claim 1, wherein the maximum current density of the field emission device exceeds 900 microamps per square centimeter.

35. The field emission device of claim 1, wherein the maximum current density of the field emission device exceeds 2.7 milliamps per square centimeter.

36. The field emission device of claim 1, further comprising a plurality of conductive electrodes aligned in rows, wherein the plurality of conductive electrodes is operatively connected by an electronic circuit such that emission of electrons from the plurality of conductive electrodes is scrolled and the plurality of anodes are aligned such that light emitted from the light-emitting layer of at least a portion of at least one of the rows of the plurality of anodes is scrolled.

37. The field emission device of claim 36, wherein the electronic circuit includes a triode structure for each of the plurality of conductive electrodes, such that the intensity of the light emitted by the light-emitting layer of each of the plurality of anodes is capable of being independently controlled.

38. The field emission device of claim 36, wherein the light is scrolled such that successive rows of the plurality of anodes emit light.

39. The field emission device of claim 38, wherein the peak luminance of the backlight is at least 1000 cd/m$^2$.

40. The field emission device of claim 38, wherein the peak luminance of the backlight is at least 3000 cd/m$^2$.

41. The field emission device of claim 36, wherein the liquid crystal television has a diagonal screen measurement of at least 30 inches.

* * * * *